US007748922B2

(12) United States Patent
Cheng

(10) Patent No.: US 7,748,922 B2
(45) Date of Patent: Jul. 6, 2010

(54) RING BINDER MECHANISM WITH DUAL PIVOT LOCKING ELEMENTS

(75) Inventor: Hung Yu Cheng, Hong Kong (CN)

(73) Assignee: World Wide Stationery Manufacturing Company, Limited, Kwai Chung, New Territory (HK)

( * ) Notice: Subject to any disclaimer, the term of this patent is extended or adjusted under 35 U.S.C. 154(b) by 1085 days.

(21) Appl. No.: 11/080,700

(22) Filed: Mar. 15, 2005

(65) Prior Publication Data

US 2005/0201817 A1 Sep. 15, 2005

Related U.S. Application Data

(63) Continuation-in-part of application No. 10/870,168, filed on Jun. 17, 2004, now Pat. No. 7,275,886.

(60) Provisional application No. 60/553,231, filed on Mar. 15, 2004.

(51) Int. Cl.

| | |
|---|---|
| ***B42F 13/00*** | (2006.01) |
| ***B42F 3/00*** | (2006.01) |
| ***B42F 13/40*** | (2006.01) |
| ***B42F 13/20*** | (2006.01) |
| ***B42F 3/04*** | (2006.01) |

(52) U.S. Cl. ..... 402/26; 402/4; 402/31; 402/35; 402/36; 402/38; 402/75

(58) Field of Classification Search ..... 402/4, 402/8 R, 16, 20, 25, 70, 73, 79, 501; *B42F 3/00, B42F 13/00, 13/26*

See application file for complete search history.

(56) References Cited

U.S. PATENT DOCUMENTS 566,717 A 8/1896 Krah (Continued)

FOREIGN PATENT DOCUMENTS

DE 10119121 A1 10/2001

(Continued)

OTHER PUBLICATIONS

Kokuyo Lock Ring Mechanism with description, two instruction sheets, and nine photographs, undated but admitted as prior art, 12 pgs.

(Continued)

*Primary Examiner*—Dana Ross
*Assistant Examiner*—Justin V Lewis
(74) *Attorney, Agent, or Firm*—Senniger Powers LLP

(57) ABSTRACT

A ring binder mechanism that retains loose-leaf pages and has ring members that are easy to open and close and that readily lock together when closed. The mechanism comprises a housing that supports two hinge plates for loose pivoting motion. The hinge plate motion moves the ring members between an open position for loading pages and a closed position for retaining pages. A control structure is movable by a lever, which is pivotally mounted on the housing, between a first and second position. In the first position, pivoting motion of the hinge plates is blocked, and in the second position, the hinge plates can freely pivot. In one aspect of the invention, a spring is engageable with the lever for urging the lever to move the control structure toward the first position.

17 Claims, 22 Drawing Sheets

U.S. PATENT DOCUMENTS

| | | | |
|---|---|---|---|
| 651,254 | A | 6/1900 | Krah |
| 683,019 | A | 9/1901 | Buchanan |
| 790,382 | A | 5/1905 | McBride |
| 854,074 | A | 5/1907 | Bryant |
| 857,377 | A | 6/1907 | Baker |
| 974,831 | A | 11/1910 | Scherzinger |
| 1,011,391 | A | 12/1911 | Sturgis |
| 1,163,179 | A | 12/1915 | Schade, Jr. |
| 1,168,260 | A | 1/1916 | Albrecht |
| 1,398,034 | A | 11/1921 | Mero |
| 1,398,388 | A | 11/1921 | Murphy |
| 1,733,548 | A | 10/1929 | Martin |
| 1,733,894 | A | 10/1929 | Martin |
| 1,787,957 | A | 1/1931 | Schade |
| 1,822,669 | A | 9/1931 | Schade |
| 1,857,291 | A | 5/1932 | Trussell |
| 1,953,981 | A | 4/1934 | Trussell |
| 1,991,362 | A | 2/1935 | Krag |
| 1,996,463 | A | 4/1935 | Dawson et al. |
| 2,004,570 | A | 6/1935 | Dawson |
| 2,013,416 | A | 9/1935 | McClure |
| 2,024,461 | A | 12/1935 | Lotter |
| 2,067,846 | A | 1/1937 | Cooper |
| 2,075,766 | A | 3/1937 | Rand |
| 2,089,211 | A | 8/1937 | Krag |
| 2,096,944 | A | 10/1937 | Unger et al. |
| 2,103,307 | A | 12/1937 | Unger |
| 2,105,235 | A | 1/1938 | Schade |
| 2,158,056 | A | 5/1939 | Cruzan |
| 2,179,627 | A | 11/1939 | Handler |
| 2,204,918 | A | 6/1940 | Trussell |
| 2,218,105 | A | 10/1940 | Griffin |
| 2,236,321 | A | 3/1941 | Ostrander |
| 2,239,062 | A | 4/1941 | Tallmadge |
| 2,239,121 | A | 4/1941 | St. Louis et al. |
| 2,251,878 | A | 8/1941 | Hanna |
| 2,252,422 | A | 8/1941 | Unger |
| 2,260,929 | A | 10/1941 | Bloore |
| 2,288,189 | A | 6/1942 | Guinane |
| 2,304,716 | A | 12/1942 | Supin |
| 2,311,492 | A | 2/1943 | Unger |
| 2,322,595 | A | 6/1943 | Schade |
| 2,338,011 | A | 12/1943 | Schade |
| 2,421,799 | A | 6/1947 | Martin |
| 2,528,866 | A | 11/1950 | Dawson, Jr. |
| 2,543,866 | A | 3/1951 | Panfil |
| 2,552,076 | A | 5/1951 | Wedge |
| 2,612,169 | A | 9/1952 | Segal |
| 2,789,561 | A | 4/1957 | Bonn |
| 2,865,377 | A | 12/1958 | Schroer et al. |
| 2,871,711 | A | 2/1959 | Stark |
| 2,891,553 | A | 6/1959 | Acton |
| 2,894,513 | A | 7/1959 | Gempe |
| 3,077,888 | A | 2/1963 | Thieme |
| 3,098,489 | A | 7/1963 | Vernon |
| 3,098,490 | A | 7/1963 | Wance |
| 3,101,719 | A | 8/1963 | Vernon |
| 3,104,667 | A | 9/1963 | Mintz |
| 3,149,636 | A | 9/1964 | Rankin |
| 3,190,293 | A | 6/1965 | Schneider et al. |
| 3,205,894 | A | 9/1965 | Rankin |
| 3,205,895 | A | 9/1965 | Johnson |
| 3,255,759 | A | 6/1966 | Dennis |
| 3,348,550 | A | 10/1967 | Wolf et al. |
| 3,718,402 | A | 2/1973 | Schade |
| 3,748,051 | A | 7/1973 | Frank |
| 3,884,586 | A | 5/1975 | Michaelis et al. |
| 3,954,343 | A | 5/1976 | Thomsen |
| 3,993,374 | A | 11/1976 | Schudy et al. |
| 4,127,340 | A | 11/1978 | Almgren |
| 4,130,368 | A | 12/1978 | Jacoby et al. |
| 4,352,582 | A | 10/1982 | Eliasson |
| 4,486,112 | A | 12/1984 | Cummins |
| 4,522,526 | A | 6/1985 | Lozfau |
| 4,566,817 | A | 1/1986 | Barrett, Jr. |
| 4,571,108 | A | 2/1986 | Vogl |
| 4,696,595 | A | 9/1987 | Pinkney |
| 4,798,491 | A | 1/1989 | Lässle |
| 4,813,803 | A | 3/1989 | Gross |
| 4,815,882 | A | 3/1989 | Ohminato |
| 4,886,390 | A | 12/1989 | Silence |
| 4,919,557 | A | 4/1990 | Podosek |
| 5,067,840 | A | 11/1991 | Cooper |
| 5,116,157 | A | 5/1992 | Gillum et al. |
| 5,135,323 | A | 8/1992 | Pinheiro |
| 5,180,247 | A | 1/1993 | Yu |
| 5,255,991 | A | 10/1993 | Sparkes |
| 5,286,128 | A | 2/1994 | Gillum |
| 5,332,327 | A | 7/1994 | Gillum |
| 5,346,325 | A | 9/1994 | Yamanoi |
| 5,354,142 | A | 10/1994 | Yu |
| 5,368,407 | A | 11/1994 | Law |
| 5,378,073 | A | 1/1995 | Law |
| 5,393,155 | A | 2/1995 | Ng |
| 5,393,156 | A | 2/1995 | Mullin et al. |
| 5,476,335 | A | 12/1995 | Whaley |
| 5,524,997 | A | 6/1996 | von Rohrscheidt |
| 5,577,852 | A | 11/1996 | To |
| 5,651,628 | A | 7/1997 | Bankes |
| 5,660,490 | A | 8/1997 | Warrington |
| 5,692,847 | A | 12/1997 | Zane et al. |
| 5,692,848 | A | 12/1997 | Wada |
| 5,718,529 | A | 2/1998 | Chan |
| 5,782,569 | A | 7/1998 | Mullin et al. |
| 5,788,392 | A | 8/1998 | Cheung |
| 5,807,006 | A | 9/1998 | Cheung |
| 5,810,499 | A | 9/1998 | Law |
| 5,816,729 | A | 10/1998 | Whaley |
| 5,836,709 | A | 11/1998 | Cheung |
| 5,868,513 | A | 2/1999 | Law |
| 5,879,097 | A | 3/1999 | Cheng |
| 5,882,135 | A | 3/1999 | Ko |
| 5,895,164 | A | 4/1999 | Wu |
| 5,924,811 | A | 7/1999 | To |
| 5,957,611 | A | 9/1999 | Whaley |
| 5,975,785 | A | 11/1999 | Chan |
| 6,036,394 | A | 3/2000 | Cheng |
| 6,142,697 | A | 11/2000 | Williams |
| 6,146,042 | A | 11/2000 | To |
| 6,155,737 | A | 12/2000 | Whaley |
| 6,203,229 | B1 | 3/2001 | Coerver |
| 6,206,601 | B1 | 3/2001 | Ko |
| 6,217,247 | B1 | 4/2001 | Ng |
| 6,270,279 | B1 | 8/2001 | Whaley |
| 6,276,862 | B1 * | 8/2001 | Snyder et al. ..... 402/40 |
| 6,293,722 | B1 | 9/2001 | Holbrook et al. |
| 6,364,558 | B1 | 4/2002 | To |
| 6,371,678 | B1 | 4/2002 | Chizmar |
| 6,467,984 | B1 | 10/2002 | To |
| 6,474,897 | B1 | 11/2002 | To |
| 6,533,486 | B1 | 3/2003 | To |
| 6,749,357 | B2 | 6/2004 | Cheng |
| 6,758,621 | B2 | 7/2004 | To |
| 6,821,045 | B2 | 11/2004 | Whaley |
| 6,840,695 | B2 | 1/2005 | Horn |
| 6,916,134 | B2 | 7/2005 | Wong |
| 7,296,946 | B2 | 11/2007 | Cheng |
| 2002/0122687 | A1 * | 9/2002 | Horn ..... 402/16 |
| 2003/0044221 | A1 | 3/2003 | To |
| 2003/0103797 | A1 | 6/2003 | Cheng |
| 2003/0103798 | A1 | 6/2003 | Cheng et al. |
| 2003/0123923 | A1 | 7/2003 | Koike et al. |
| 2005/0013654 | A1 | 1/2005 | Cheng et al. |
| 2005/0201817 | A1 | 9/2005 | Cheng |

| | | | |
|---|---|---|---|
| 2005/0201818 | A1 | 9/2005 | Cheng |
| 2005/0201819 | A1 | 9/2005 | Cheng |
| 2005/0201820 | A1 | 9/2005 | Ng |
| 2005/0207826 | A1 | 9/2005 | Cheng |
| 2005/0214064 | A1 | 9/2005 | Ng et al. |
| 2005/0232689 | A1 | 10/2005 | Cheng |
| 2006/0008318 | A1 | 1/2006 | Ng |
| 2006/0056906 | A1 | 3/2006 | Horn |
| 2006/0088365 | A1 | 4/2006 | Whaley |
| 2006/0147253 | A1 | 7/2006 | Cheng |
| 2006/0147254 | A1 | 7/2006 | Cheng |
| 2006/0147255 | A1 | 7/2006 | Cheng |
| 2006/0153628 | A1 | 7/2006 | Tanaka |
| 2006/0153629 | A1 | 7/2006 | Cheng |
| 2006/0216107 | A1 | 9/2006 | Lin |
| 2006/0228164 | A1 | 10/2006 | Horn |
| 2006/0251467 | A1 | 11/2006 | Cheng |
| 2006/0251468 | A1 | 11/2006 | Cheng |
| 2007/0086836 | A1 | 4/2007 | Cheng |

FOREIGN PATENT DOCUMENTS

| | | | |
|---|---|---|---|
| EP | 1316438 | A1 | 4/2003 |
| EP | 1323545 | A2 | 7/2003 |
| EP | 1431065 | A2 | 6/2004 |
| FR | 1 336 765 | | 7/1962 |
| FR | 1336765 | | 9/1963 |
| FR | 1 346 864 | A | 12/1963 |
| FR | 1346864 | | 12/1963 |
| FR | 2221924 | | 10/1974 |
| FR | 2 238 332 | A | 2/1975 |
| FR | 2238332 | | 2/1975 |
| GB | 868724 | | 5/1961 |
| GB | 906279 | | 9/1962 |
| GB | 952536 | | 3/1964 |
| GB | 2231536 | A | 11/1990 |
| GB | 2251215 | A | 7/1992 |
| GB | 2275023 | A | 8/1994 |
| GB | 2292343 | A | 2/1996 |
| GB | 2387815 | A | 10/2003 |
| JP | 59-79379 | | 5/1984 |
| JP | 61-18880 | | 2/1986 |
| JP | 01299095 | A | 12/1989 |
| JP | 1299095 | A | 12/1989 |
| JP | 2034289 | U | 3/1990 |
| JP | 4-120085 | | 10/1992 |
| JP | 2004098417 | A | 4/2004 |
| WO | 0119620 | A1 | 3/2001 |
| WO | WO 01/19620 | A1 | 3/2001 |
| WO | 0181099 | A1 | 11/2001 |

OTHER PUBLICATIONS

ESR for EP 07107068 dated Oct. 4, 2007, 1 pg.

Office Action dated Apr. 20, 2007 from related U.S. Appl. No. 10/323,052, now issued as U.S. Patent No. 7,296,946, 12 pages—(see p. 4).

Office action dated Jan. 12, 2009 from related U.S. Appl. No. 11/688,735, 10 pgs.

Response filed Feb. 20, 2009 to Office action dated Jan. 12, 2009 in related U.S. Appl. No. 11/688,735, 10 pgs.

* cited by examiner

RING BINDER MECHANISM WITH DUAL PIVOT LOCKING ELEMENTS

CROSS REFERENCE TO RELATED APPLICATION

This application claims the benefit of U.S. patent application Ser. No. 10/870,168 filed Jun. 17, 2004, and entitled Positive Lock Ring Binder Mechanism, which is a non-provisional application of U.S. Pat. Appl. Ser. No. 60/553,231, filed Mar. 15, 2004, and entitled Positive Lock Ring Binder Mechanism, the entire disclosures of which are hereby incorporated by reference.

BACKGROUND OF THE INVENTION

This invention relates to a ring binder mechanism for retaining loose-leaf pages, and in particular to an improved mechanism for controlling opening and closing movement of rings, for reducing snapping force of closing rings, and for securely holding closed rings in a locked position.

A ring binder mechanism retains loose-leaf pages, such as hole-punched pages, in a file or notebook. It has rings formed by two ring members for retaining the pages. The rings may be selectively opened to add or remove pages to the rings or closed to retain pages on the rings while allowing the pages to move along the rings. The ring members of each ring mount on two adjacent hinge plates. The hinge plates join together about a pivot axis for pivoting movement within an elongate housing. The housing holds the hinge plates so they may pivot relative to the housing and move the ring members between an open position and a closed position.

The undeformed housing is narrower than the joined hinge plates when the hinge plates are in a coplanar position (180°). So as the hinge plates pivot through this position, they deform the resilient housing and cause a spring force in the housing that urges the hinge plates to pivot away from the coplanar position and move the ring members to either their open or closed position. This force is generally large to hold the hinge plates against unwanted separation or opening of the rings. As a result, when the hinge plates move through the co-planar position, they do so with a strong snapping movement. This snaps the ring members together when they close and snaps them apart when they open. When the ring members close, there is a concern that they may rapidly snap together with a force that might cause fingers to be pinched in the ring members.

The housing spring force can also make it difficult to move the hinge plates through the co-planar position. As a result, it may be hard for an operator to open or close the ring members. In addition, the housing may begin to permanently deform over time because of the repeated deformation when pivoting the hinge plates. This may reduce the housing's ability to uniformly hold the ring members together when they are closed and may allow gaps to form between the closed ring members. Pages may escape from the closed rings. Furthermore, in may of these mechanisms the ring members do not positively lock together when they are closed. So if the mechanism is accidentally dropped, the ring members may unintentionally open and allow pages to fall out.

Accordingly, there is a need for a ring binder mechanism in which rings are easy to open and close, in which the ring members of the rings do not strongly snap together, and in which the ring members lock together to securely retain pages on the closed rings.

SUMMARY OF THE INVENTION

This invention relates generally to a ring binder mechanism for retaining loose-leaf pages. The mechanism comprises a housing and hinge plates supported by the housing for pivoting motion about a pivot axis. The mechanism also includes rings for holding the loose-leaf pages, and each ring includes a first ring member and a second ring member. The first ring member is mounted on a first hinge plate and moveable with the pivoting motion of the first hinge plate relative to the second ring member between a closed and open position. In the closed position, the two ring members form a substantially continuous, closed loop for allowing loose-leaf pages retained by the rings to be moved along the rings from one ring member to the other. In the open position, the two ring members form a discontinuous, open loop for adding or removing loose-leaf pages from the rings. The mechanism further includes a control structure, which comprises a lever pivotally mounted on the housing, a travel bar operatively connected to the lever, and one link pivotally connected to the housing and to the travel bar. The link captures the hinge plates for use in driving pivoting motion of the hinge plates toward the closed positions of the ring members and toward the open positions of the ring members. The lever is pivotable on the housing to move the travel bar generally lengthwise of the housing and thereby pivot the links for use in controlling the pivoting motion of the hinge plates.

In another aspect, the ring binder mechanism includes a control structure supported by the housing and comprising a lever, a travel bar, at least one link, and a spring engaging the lever. The travel bar is operatively connected to the travel bar, and the link is connected to the travel bar and the housing. The control structure is movable relative to the housing between a first position corresponding to the closed positions of the ring members and a second position. The link is engageable with at least one of the hinge plates in the first position for blocking the hinge plates from pivoting to move the ring members to their open positions. This locks the ring members in their closed position. The spring is oriented to bias the lever toward the first position of the control structure.

Other features of the invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE INVENTION

Figure 1:
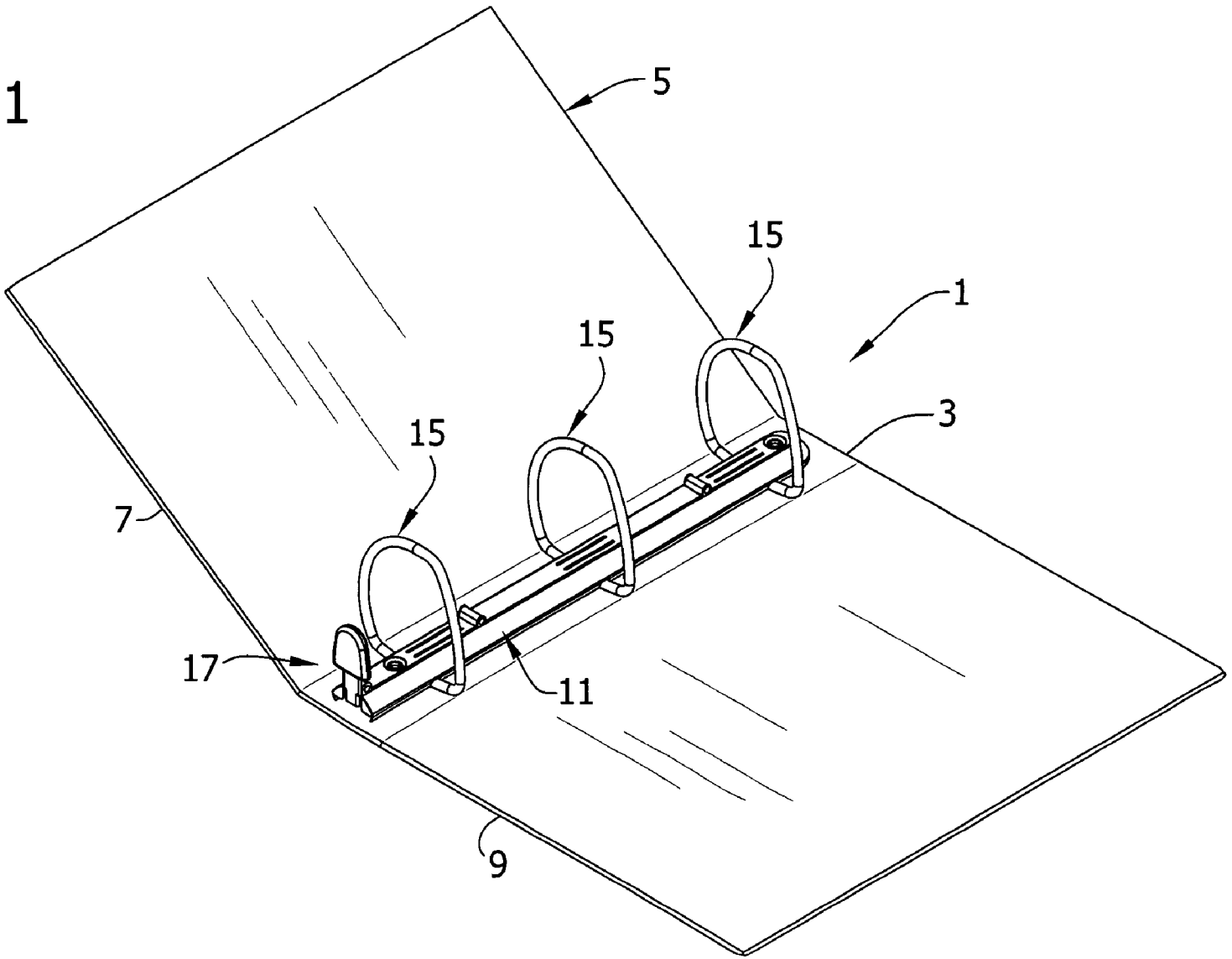
FIG. 1 is a perspective of a notebook incorporating a ring binder mechanism according to a first embodiment of the invention.

Referring to the drawings, FIGS. 1-9 show a ring binder mechanism according to a first embodiment of the invention. The ring mechanism is designated generally by reference numeral 1 and is typically used to retain loose-leaf pages (not shown) in a file or notebook. FIG. 1 shows the mechanism 1 mounted on a spine 3 of a notebook (designated generally by reference numeral 5), which includes a front cover 7 and back cover 9 hingedly attached to the spine for moving to selectively cover or expose pages retained by the mechanism 1. It is to be understood that a ring binder mechanism mounted on a surface other than a file or notebook does not depart from the scope of this invention.

As shown in FIGS. 2-4, 7, and 8, the ring mechanism 1 includes a housing (designated generally by reference numeral 11), two hinge plates (each designated generally by reference numeral 13), three rings (each designated generally by reference numeral 15), and a control structure (designated generally by reference numeral 17). Briefly, the housing 11 supports the control structure 17 and hinge plates 13 for moving the rings 15 mounted on the hinge plates between a closed position (FIGS. 3 and 4) for retaining loose-leaf pages and an open position (FIGS. 7 and 8) suitable for adding or removing pages. The control structure 17 is pivotally mounted on the housing 11 and controllably pivots the hinge plates 13 within the housing to move the rings 15. Complete operation of the ring mechanism 1 will be described in greater detail hereinafter.

The housing 11 is shaped as an elongated rectangle with a uniform, roughly arch-shaped cross section, having at its center a plateau 19. A first longitudinal end of the housing 11 is generally open while an opposing longitudinal end is closed. Four openings 21*a-d* are provided in the housing plateau 19 between the housing's longitudinal ends. First and fourth openings 21*a*, 21*d* are circular in shape and located adjacent respective longitudinal ends of the housing 11. Second and third openings 21*b*, 21*c* are rectangular in shape with each opening located inward of a respective one of the circular openings 21*a*, 21*d*. A bent under rim 23 is formed along each longitudinal edge margin of the housing 11, and three uniformly spaced openings, each designated by reference numeral 25, are formed in each rim. Pairs of tabs (each tab being designated by reference numeral 27) project upward from the plateau 19 of the housing 11 at the open end of the housing and at each rectangular opening 21*b*, 21*c*. The function of the tabs 27 will be described hereinafter. It is envisioned that the housing 11 is made of metal, but it may be made of other material that is sufficiently rigid to provide a stable mount for components of the mechanism 1 while being sufficiently resilient to function as a spring. It is also envisioned that the housing tabs 27 are integral with the housing 11, but they may be formed separately from the housing and attached thereto without departing from the scope of the invention. Mechanisms having housings of other shapes, including irregular shapes, or housings that are integral with a file or notebook do not depart from the scope of this invention.

Figure 2:
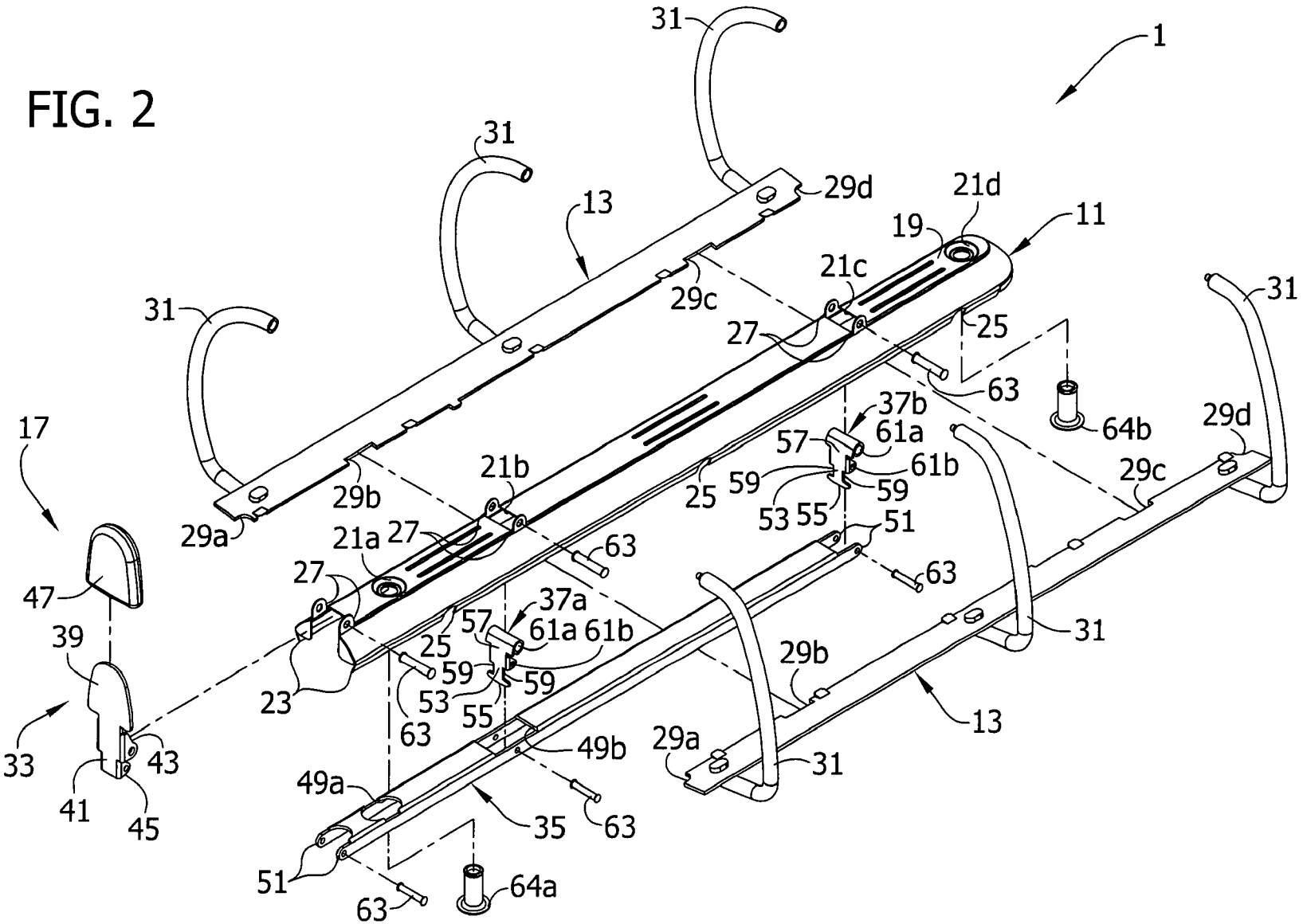
FIG. 2 is an exploded perspective of the ring binder mechanism of FIG. 1.

As best shown in FIG. 2, the two hinge plates 13 of the ring mechanism 1 are substantially identical and are generally mirror images of each other. The hinge plates 13 are each generally shorter than a corresponding length of the housing 11. The hinge plates 13 are each thin and elongate and are generally rectangular in shape. They each have inner and outer longitudinal edge margins and opposing longitudinal ends. Four cutouts 29*a-d* are formed in each plate along the inner edge margin. First and fourth cutouts 29*a*, 29*d* are arcuate in shape and are located at each end of each hinge plate 13. Second and third cutouts 29*b*, 29*c* are rectangular in shape and are located inward from respective ones of the arcuate cutouts 29*a*, 29*d*. The purpose of the cutouts 29*a-d* will become apparent hereinafter.

Figure 3:
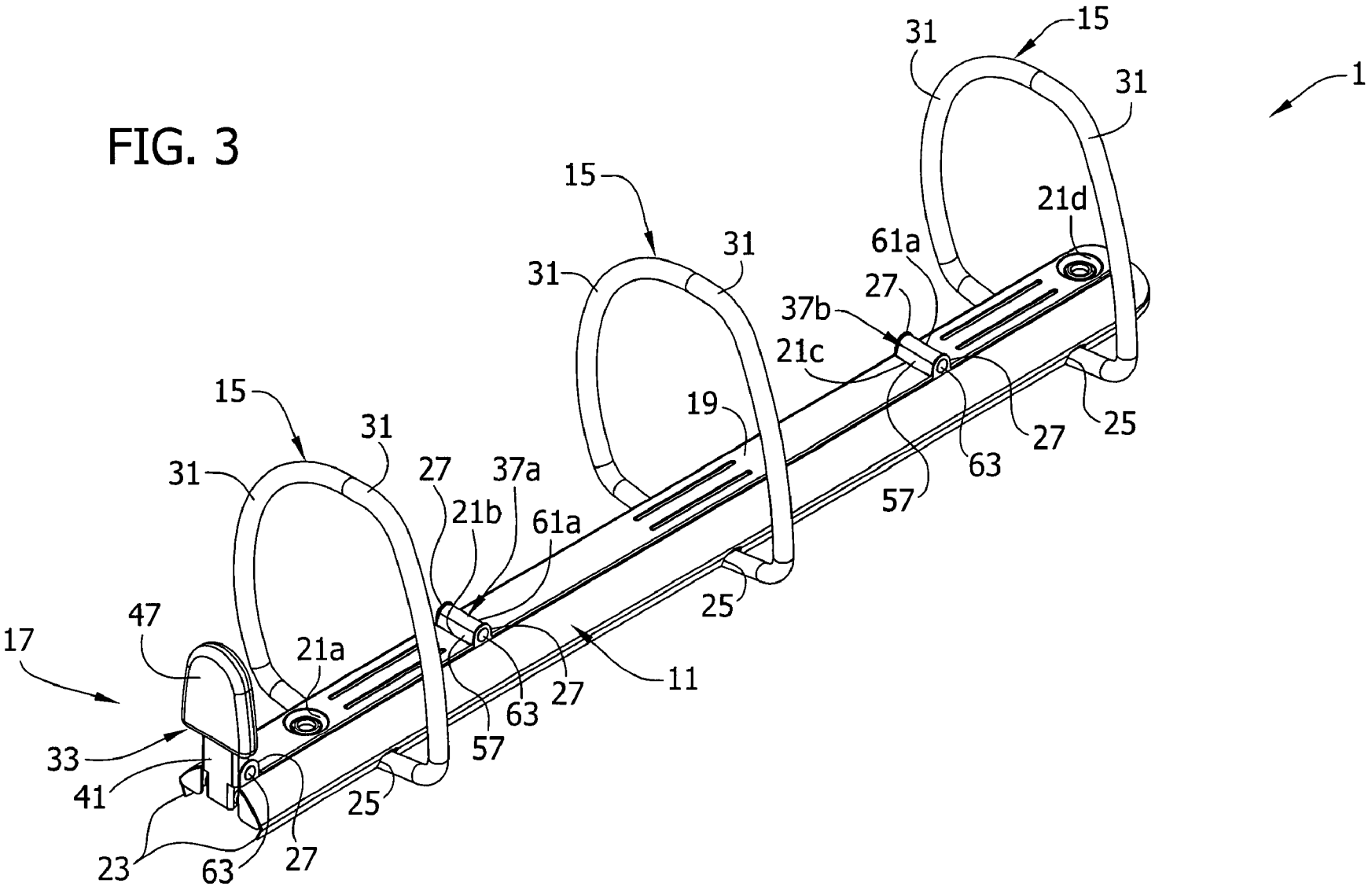
FIG. 3 is a perspective of the ring binder mechanism at a closed and locked position.

As shown in FIGS. 1 and 3, the three rings 15 are each D-shaped when closed and viewed in elevation. As shown in FIG. 2, the rings 15 each include two ring members 31 (each designated by reference numeral 31) that join together to form the D-shaped ring 15 when the rings are closed. Free ends of the ring members 31 of each ring 15 are formed with suitable mating structure to securely hold the ring members together against transverse misalignment (i.e., transverse to longitudinal axes of the ring members) when the ring members are in the closed position. It is envisioned that the ring members 31 are each formed from a conventional, cylindrical rod of circular cross-section and of suitable material (e.g., steel) to retain pages on the mechanism 1. But ring binder mechanisms with ring members formed from a different material or having a different cross-section shape, or ring binder mechanisms with ring members that form different shaped rings when closed, for example circular shaped rings, do not depart from the scope of the invention.

Figure 6:
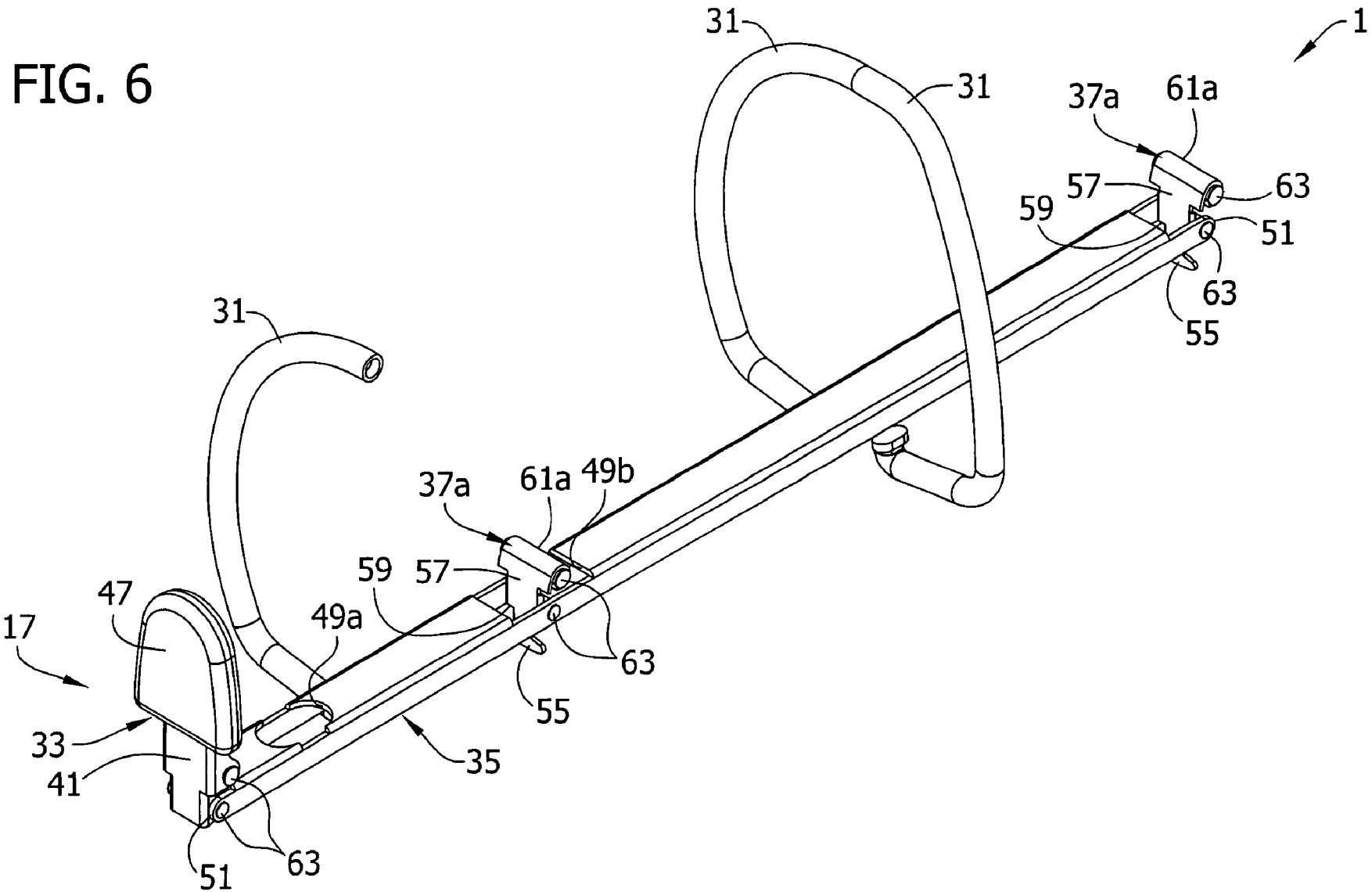
FIG. 6 is an enlarged perspective of a control structure and of ring members of the ring mechanism.

As shown in FIGS. 2 and 6, the control structure 17 includes a lever (designated generally by reference numeral 33), a travel bar (designated generally by reference numeral 35), and two links (designated generally by reference numerals 37*a*, 37*b*). The lever 33 (broadly, an "actuator) is mushroom shaped with a larger, curved head 39 positioned on top of a narrow, generally rectangular neck 41. Two pairs of tabs project (to the right in FIG. 2) from the lever 33 at opposing longitudinal edges of its neck 41; a pair of upper tabs (each tab designated by reference numeral 43) are located above a pair of lower tabs (each tab designated by reference numeral 45) such that the upper tabs are nearer the head 39. The lever 33 also includes a cap 47 that releasably fits over the head 39 of the lever. In the illustrated ring mechanism 1, the head 39 and neck 41 of the lever 33 are one piece. But a ring mechanism having a lever with a head formed separate from a neck and subsequently attached to the neck does not depart from the scope of this invention. It is envisioned that the tabs 43, 45 are formed integral with the lever neck 41, but a lever with tabs formed separate from the neck and subsequently attached thereto does not depart from the scope of this invention. It is also envisioned that the cap 47 is made of flexible material, such as plastic or rubber, to easily fit over the lever head 39 and to facilitate grasping the lever 33 during operation. But a lever having a cap made from different material does not depart from the scope of the invention. In addition, a ring mechanism having a lever without a cap does not depart from the scope of the invention.

The travel bar 35 is elongate and generally inverted channel shaped, and longitudinal ends of the travel bar are open. The travel bar 35 includes two openings 49*a*, 49*b* between its longitudinal ends. A first opening 49*a* is adjacent a first longitudinal end of the travel bar 35 and is oval in shape. This oval opening 49*a* extends the full width of the travel bar 35 between longitudinal edge margins of the travel bar. A second opening 49*b* is spaced away from the oval opening 49*a* toward a longitudinal center of the travel bar 35. The second opening 49*b* is rectangular in shape and also extends the full width of the travel bar 35 between longitudinal edge margins of the travel bar. Pairs of tabs (each tab of each pair is designated by reference numeral 51) are located at each open end of the travel bar 35. Each tab 51 of each pair is located at the longitudinal edge margin of the travel bar 35 and extends longitudinally outward from the travel bar in alignment with the opposite tab of the pair such that openings in the tabs align.

The two links 37*a*, 37*b* of the control structure 17 are substantially identical. A first link 37*a* will be described with it understood that a description of a second link 37*b* would be the same. The first link 37*a* includes a tongue 53, which has an enlarged head 55, and a body 57. The tongue 53 extends away from the body 57 at a pair of shoulders 59 of the body. The link 37*a* also includes two channel shaped barrels 61*a*, 61*b* that extend generally transverse of the link. A first barrel 61*a* is located adjacent a top part of the link body 57 and a second barrel 61*b* is located below the first barrel near the shoulders 59 of the body. While in the illustrated ring mechanism 1 the link 37*a* comprises the tongue 53 and body 57 formed as one piece, a ring mechanism having a link with a tongue and body formed separate from each other and subsequently joined to form the link does not depart from the scope of this invention.

Figure 4:
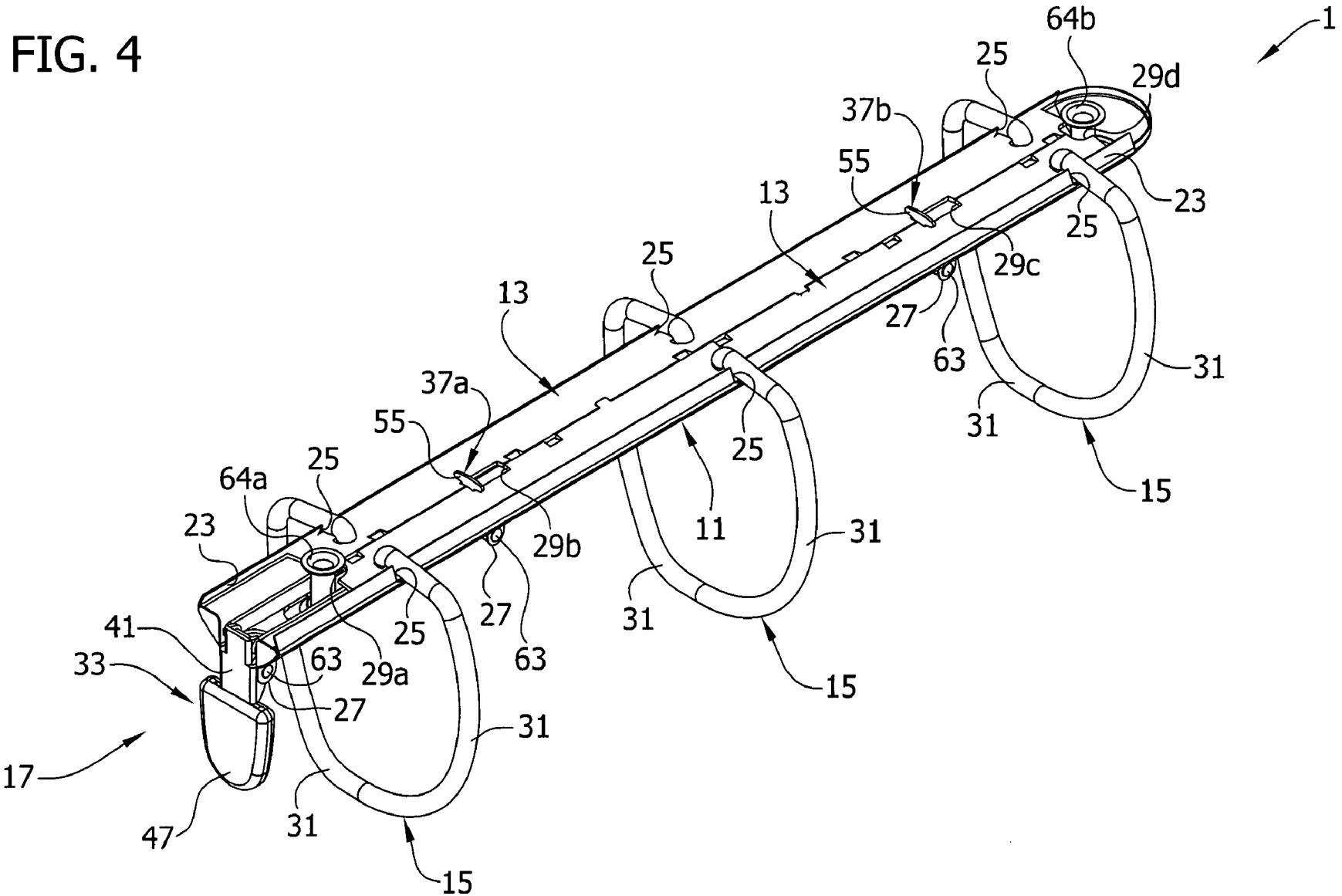
FIG. 4 is the perspective of FIG. 3 inverted.

The assembled ring binder mechanism 1 will now be described with reference to FIGS. 2-6. Orientation of the assembled components will be described with reference to the ring mechanism 1 in a closed and locked position, as shown in FIGS. 3-6. As shown in FIG. 4, the hinge plates 13 connect in parallel arrangement along their inner longitudinal edge margins to form a central hinge having a pivot axis. The interconnected hinge plates 13 fit loosely within the housing 11 such that the bent under rims 23 of the housing loosely receive the outer longitudinal edge margins of respective hinge plates 13. In this arrangement, the outer edge margins of the interconnected hinge plates 13 are free to move within the bent under rims 23 as the hinge plates pivot upward and downward about the hinge. In particular, and as will be described in greater detail hereinafter, the pivot axis moves downward (i.e., away from the housing 11 (FIG. 4)) when the hinge plates 13 pivot to close the ring members 31, and it moves upward (i.e., toward the housing 11 (FIG. 8)) when the hinge plates 13 pivot to open the ring members 31. It is understood that the housing 11 of the illustrated mechanism 1 provides a small spring force on the hinge plates 13 to bias the hinge plates 13 to pivot away from a co-planar position of the hinge plates 13. It is also understood that the spring force is strong enough to hold the hinge plates 13 in the open or closed position against free movement through the co-planar position.

As best shown in FIG. 4, the four cutouts 29*a-d* in each of the individual hinge plates 13 align to form four cutout openings (also designated 29*a-d*) in the interconnected hinge plates. The rounded first and fourth cutout openings 29*a*, 29*d* at the longitudinal ends of the interconnected hinge plates 13 align with the respective circular first and fourth openings 21*a*, 21*d* of the housing plateau 19. The rectangular second and third cutout openings 29*b*, 29*c* located inward from each of the arcuate cutout openings 29*a*, 29*d* of the interconnected hinge plates 13 align with respective rectangular second and third openings 21*b*, 21*c* of the housing plateau 19.

Ring members 31 of each ring 15 are mounted on opposite ones of the two hinge plates 13 (FIG. 2). They are positioned on the hinge plates 13 so that the free ends of the ring members 31 mate when the rings 15 are closed, forming the D-shape of each ring. The ring members 31 mount on the hinge plates 13 on a lower surface of each plate. The ring members 31 extend out from under the hinge plates 13 and pass through the respective openings 25 in the bent under rims 23 of the housing 11. The ring members 31 are rigidly connected to the hinge plates 13 so that they can move with the downward and upward pivoting motion of the hinge plates between the closed and open positions of the rings 15. Although in the illustrated ring binder mechanism 1 both ring members 31 of each ring 15 are mounted on the hinge plates 13 and move with the pivoting movement of the hinge plates, a mechanism in which each ring has one movable ring member and one fixed ring member does not depart from the scope of this invention (e.g., a mechanism in which only one of the ring members of each ring is mounted on a hinge plate with the other ring member mounted, for example, on a housing).

As shown in FIGS. 3-6, the control structure 17 of the ring mechanism 1 extends from the open end of the housing 11 toward the closed end of the housing, lengthwise of the housing and between the housing and interconnected hinge plates 13. The lever 33 pivotally mounts on the housing 11 at the tabs 27 at the open end of the housing. A hinge pin (it is understood that the hinge pins described herein are substantially the same and each is designated by reference numeral 63) passes through the upper tabs 43 of the of the lever neck 41 and through the respective housing tabs 27.

The travel bar 35 is disposed within the housing 11 behind the housing plateau 19 and above the interconnected hinge plates 13. It extends away from the lever 33 lengthwise of the housing 11 and parallel to a longitudinal axis of the housing. The tabs 51 at the open end of the travel bar 35 nearest the lever 33 connect with the lower tabs 45 of the lever neck 41 via a hinge pin 63 to connect the travel bar to the lever. The arcuate opening 49*a* of the travel bar 35 is generally vertically aligned with the circular first opening 21*a* of the housing plateau 19 and the arcuate first cutout opening 29*a* of the interconnected hinge plates 13. The rectangular opening 49*b* of the travel bar 35 is generally vertically aligned with the rectangular second opening 21*b* of the housing plateau 19 and the rectangular second cutout opening 29*b* of the hinge plates 13. The open end of the travel bar 35 furthest from the lever 33 is generally vertically aligned with the rectangular third opening 21*c* of the housing plateau 19 and the rectangular third cutout opening 29*c* of the hinge plates 13 (not shown).

Figure 5:
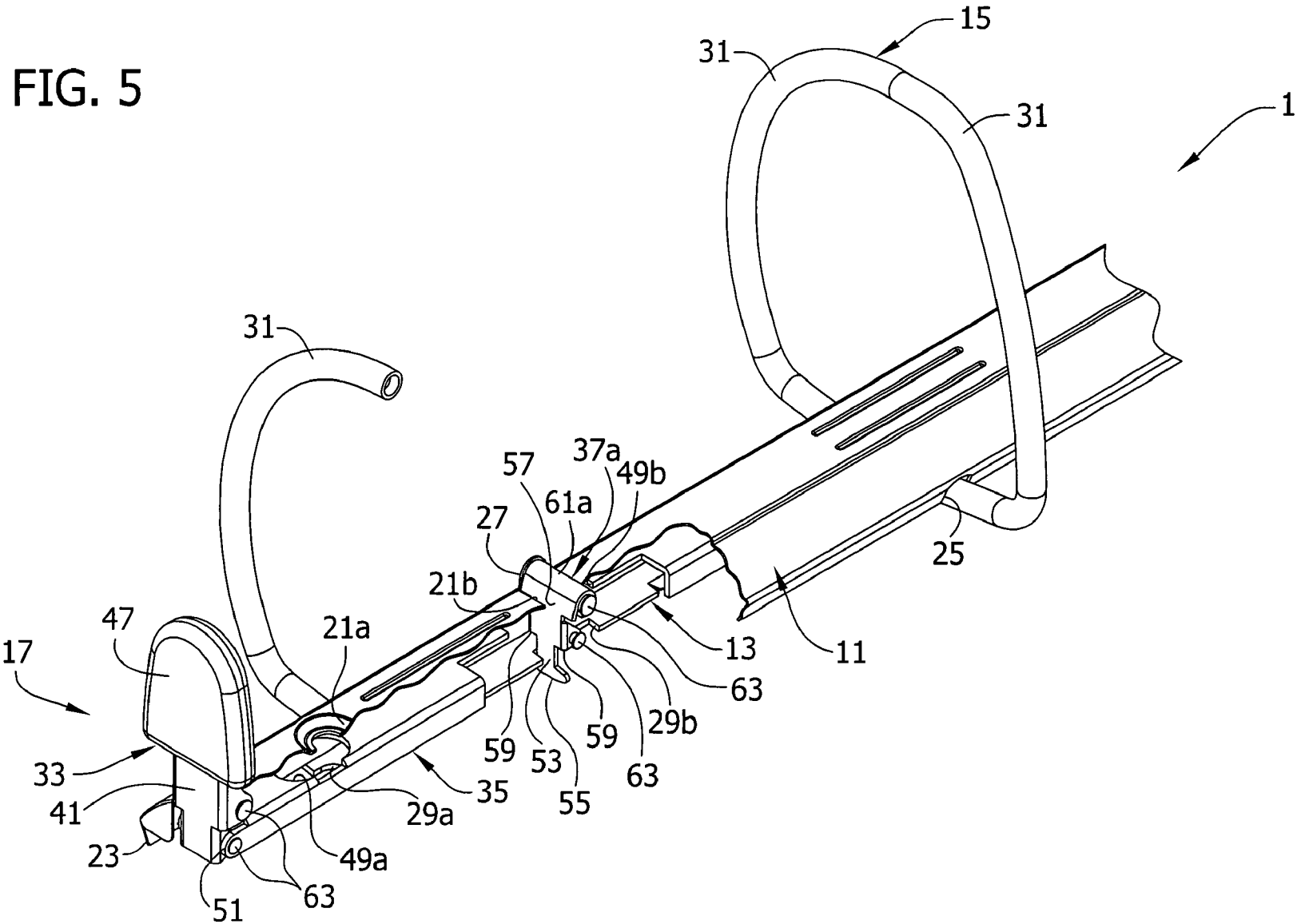
FIG. 5 is an enlarged fragmentary perspective of the ring mechanism of FIG. 3 with parts broken away to show internal construction.

As best shown in FIGS. 4-6, the links 37*a*, 37*b* (only the first link 37*a* is shown) are pivotally connected to the housing 11 and to the travel bar 35. The first link 37*a* connects to the housing 11 at the rectangular-shaped second opening 21*b* in the housing plateau 19. A hinge pin 63 passes through the tabs 27 at the housing opening 21*b* and through the upper barrel 61*a* of the link 37*a*. The link pivotally connects to the travel bar 35 at the rectangular opening 49*b* of the travel bar where another hinge pin 63 passes through longitudinal edge margin openings in the travel bar and through the lower barrel 61*b* of the link 37*a*. The second link 37*b* connects to the housing 11 at its rectangular-shaped third opening 21*c* and to the travel bar 35 near its open end furthest from the lever 33. A hinge pin (not shown) connects the second link 37*b* to the housing 11 in substantially the same fashion as the first link 37*a*; another hinge pin 63 connects the second link 37*b* to the travel bar 35 (FIG. 6) through the tabs 51 at the open end of the travel bar 35 and through the lower barrel 61*b* of the link.

The tongue 53 of each link 37*a*, 37*b* (only the first link 37*a* is shown in FIG. 5) extends through the respective rectangular second and third cutout out openings 29*b*, 29*c* of the interconnected hinge plates 13. The enlarged head 55 of each link 37*a*, 37*b* is positioned below the hinge plates 13 while the body shoulders 59 of each link are positioned above the hinge plates. The enlarged heads 55 and the shoulders 59 are wider than the respective cutout openings 29*b*, 29*c* such that the hinge plates 13 cannot move downward over the heads or upward over the shoulders. The hinge plates 13 are captured by the links 37*a*, 37*b* between their heads 55 and shoulders 59. In the closed and locked position of the ring mechanism 1, the links 37*a*, 37*b* are oriented with their enlarged heads 55 adjacent a longitudinal end of each respective rectangular hinge plate cutout opening 29*b*, 29*c* nearest the lever 33 (FIGS. 4 and 5). The enlarged heads 55 are pivoted slightly toward the lever 33 so that the links 37*a*, 37*b* are in an over-center, locking position. The shoulders 59 of each link 37*a*, 37*b* contact an upper surface of the interconnected hinge plates 13 and the enlarged head 55 of each link is spaced slightly away from (below) a lower surface of the plates. The links 37*a*, 37*b* block pivoting movement of the hinge plates 13 and lock the ring mechanism 1 closed.

As shown in FIGS. 2 and 4, the two mounting posts 64*a*, 64*b* are located at respective longitudinal ends of the housing 11. The posts 64*a*, 64*b* secure to the housing 11 by acceptable means known in the art at the circular first and fourth 21*a*, 21*d* openings of the housing plateau 19. They extend downward from the housing plateau 19 and through the respective arcuate-shaped first and fourth cutout openings 29*a*, 29*d* in the hinge plates 13. The arcuate cutout openings 29*a*, 29*d* in the interconnected hinge plates 13 allow the hinge plates to pivot relative to the mounting posts 64*a*, 64*b* without contacting them. In addition, the mounting post 64*a* at the open end of the housing 11 extends through the arcuate opening 49*a* in the travel bar 35. This allows the travel bar 35 to move relative to the mounting post 64*a* without contacting it during operation. Pivoting movement from the lever 33 is thus transmitted around the post 64*a* and to the remainder of travel bar 35 to produce translational movement of the travel bar.

Operation of the ring binder mechanism 1 between the closed and locked position and an open position will now be described. FIGS. 3-6 illustrate the ring mechanism 1 in the closed and locked position. The lever 33 is in its upright, generally vertical position, the hinge plates 13 are hinged downward so that the ring members 31 are closed, and the links 37*a*, 37*b* are in their over-center, locked position. Pivoting motion of the hinge plates 13 is blocked by the links 37*a*, 37*b* and any force tending to open the ring members 31 is firmly opposed by the two links. Upward movement of the hinge plates 13 (i.e., toward the open position) would cause the links 37*a*, 37*b* to rotate clockwise (as viewed in FIG. 5) because of their over-center position. However, the links 37*a*, 37*b* are prevented from rotation in this direction by engagement of the travel bar 35 with mounting post 64*a*.

Figure 9:
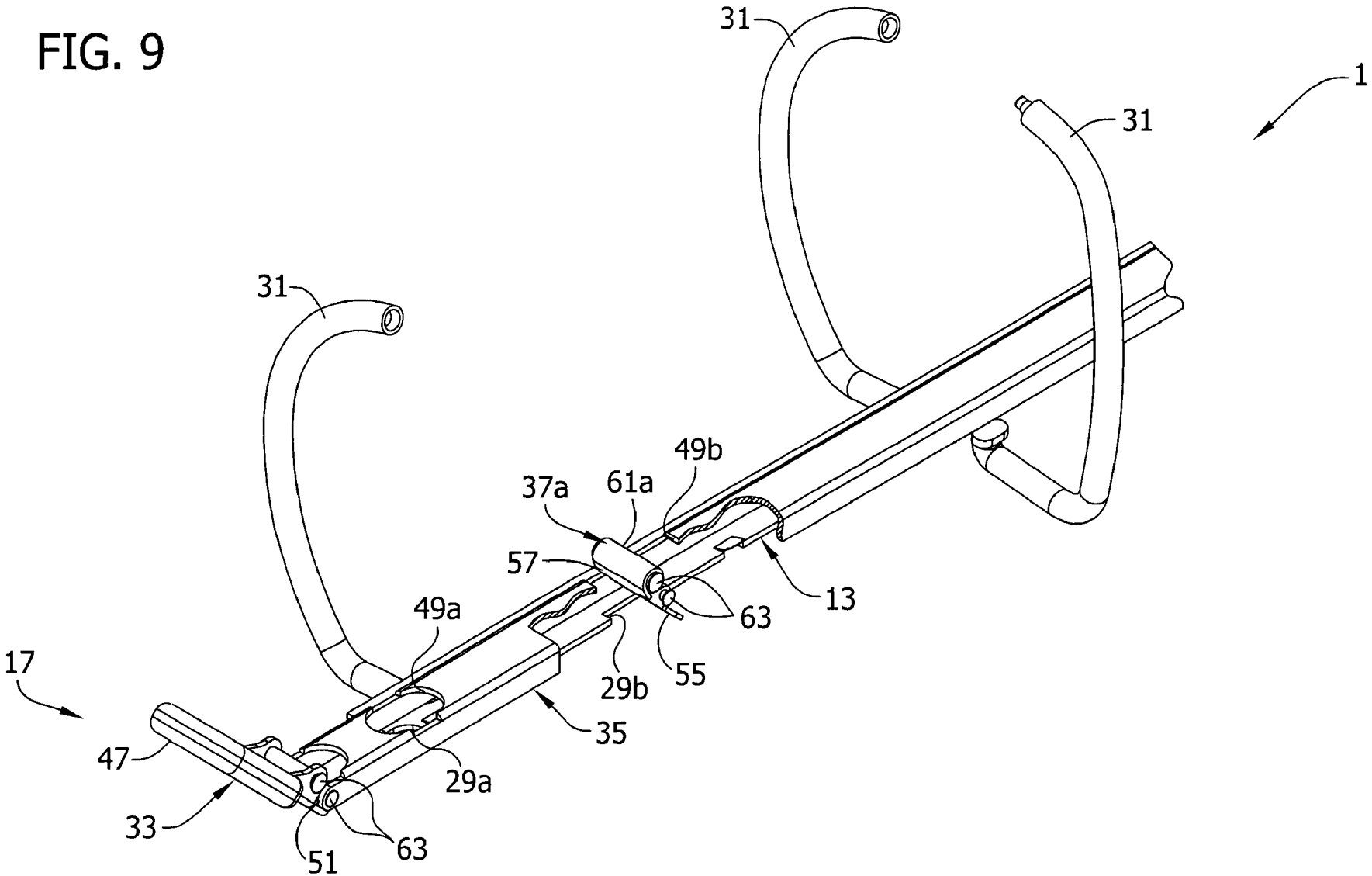
FIG. 9 is a view similar to FIG. 6 with parts of the ring mechanism broken away and with the control structure in a position corresponding to the open position of the ring mechanism.

To open the ring mechanism 1, an operator applies force to the lever head 39 (and cap 47) and progressively pivots the lever 33 outward and downward. The lever 33 pivots about the hinge pin 63 mounting it on the housing 11 and simultaneously pushes the travel bar 35 (via the pivotal connection between the lever and travel bar) away from the lever. This causes the travel bar 35 to pivotally move the links 37*a*, 37*b* away from the lever 33 and pivots the links about their connection point with the housing 11. The links 37*a*, 37*b* rotate (pivot) from their over-center, locking position, through a vertical position, and toward an open position (FIG. 9). The tongue 53 of each link 37*a*, 37*b* rotates away from the lever 33 within its respective rectangular hinge plate cutout opening 29*b*, 29*c* and moves its enlarged head 55 into engagement with the lower surface of the interconnected plates 13.

Figure 7:
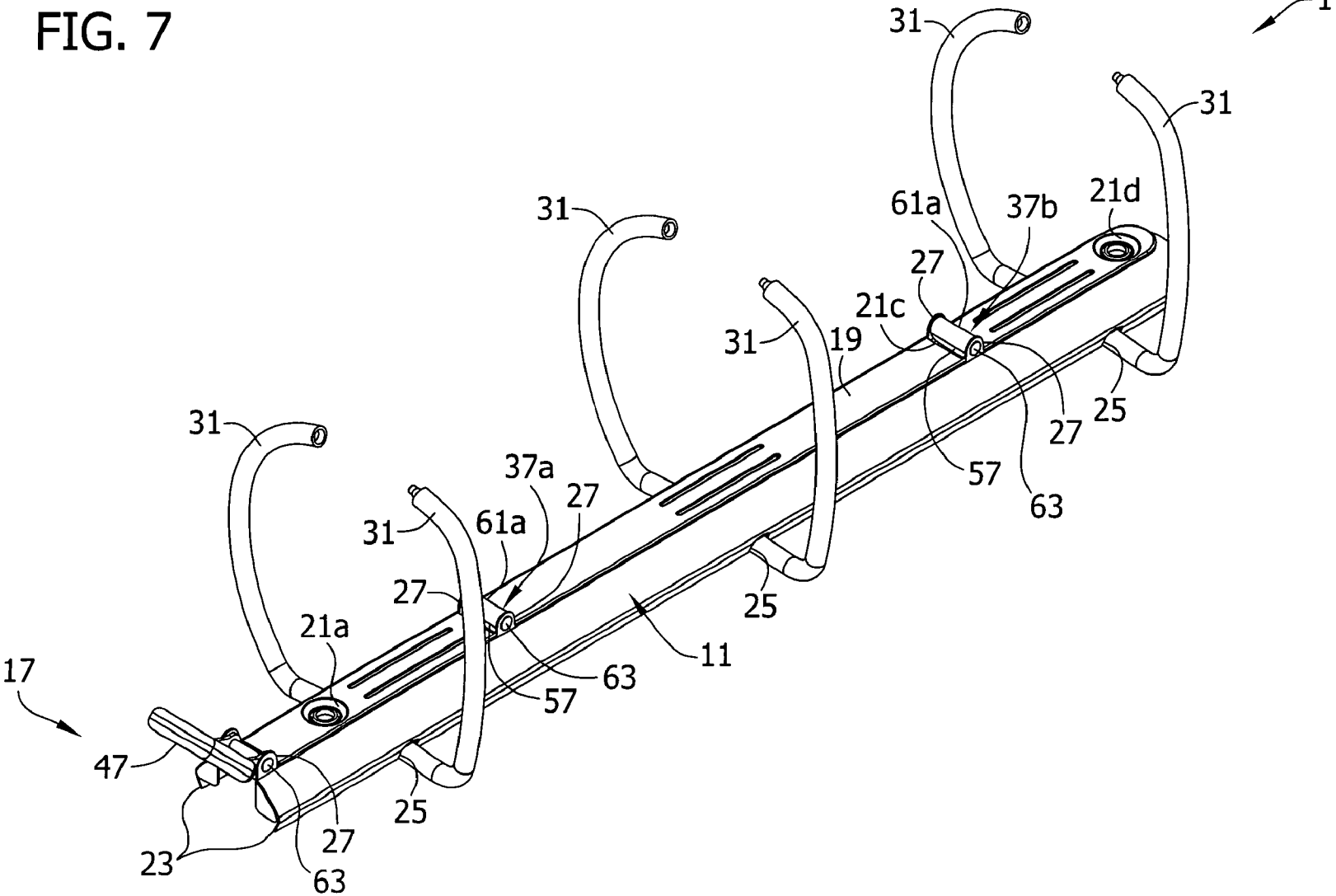
FIG. 7 is a perspective similar to FIG. 3 with the ring mechanism at an open position.
Figure 8:
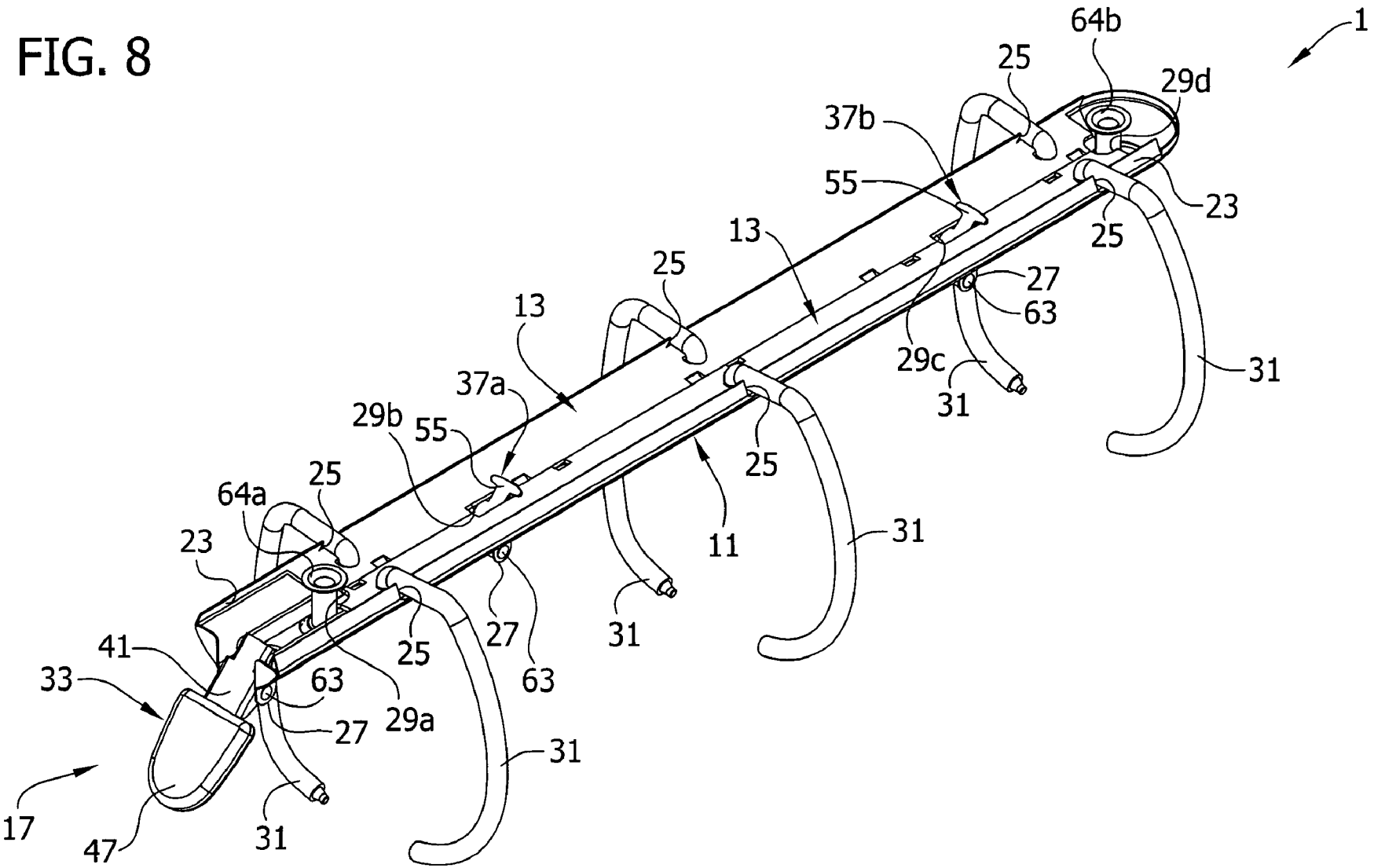
FIG. 8 is the perspective of FIG. 7 with the ring mechanism inverted.

As the operator continues to pivot the lever 33, the travel bar 35 continues to move away from the lever and further pivots each link 37*a*, 37*b*. The enlarged head 39 of each link 37*a*, 37*b* begins to push the hinge plates 13 to pivot them upward toward their co-planar position. Once the plates 13 pass through the co-planar position, the spring force of the housing 11 causes them to pivot fully upward and open the ring members 31. This is shown in FIGS. 7-9.

To close the open ring members 31 and return the ring mechanism 1 to the locked position, the operator may either pivot the lever 33 upward and inward or may manually push the ring members together. Pivoting the lever 33 pulls the travel bar 35 toward the lever. This correspondingly pivots the links 37*a*, 37*b* back toward the lever 33. The link shoulders 59 push down on the hinge plates 13 and cause the plates to pivot downward. As soon as the hinge plates 13 pass through the co-planar position, the housing spring force biases them to pivot fully downward and close the ring members 31. As this occurs, the operator continues to pivot the lever 33 to pull the travel bar 35 and links 37*a*, 37*b* back to their locked position (FIG. 5) with the links over-center and blocking the hinge plates from pivoting.

Closing the ring members 31 by manually pushing them together similarly pivots the hinge plates 13 downward and through their co-planar position. The downward movement of the hinge plates 13 cams the links 37*a*, 37*b* and causes them to pivot slightly toward the lever 33. This pushes the travel bar 35 toward the lever 33 and causes the lever to being pivoting upward and inward. At this time, the ring members 31 are closed but the ring mechanism 1 is not locked. The operator can lock the mechanism 1 by pivoting the lever 33 to its full vertical position, which pulls the travel bar 35 and links 37*a*, 37*b* to their locked position in which the links are over-center.

A benefit of the ring mechanism 1 of the invention is that the links 37*a*, 37*b* in cooperation with the travel bar 35 and the post 64*a* firmly block the hinge plates 13 from pivoting upward toward the housing 11 and thus securely holds the ring members 31 closed. Therefore, the housing spring force can be significantly reduced as it is no longer required to hold the ring members 231 closed. Another benefit of the ring mechanism 1 of the invention is that the links 37*a*, 37*b* are uniquely connected to the housing 11 and travel bar 35 for pivotal movement to operate the hinge plates 13. This arrangement provides increased leverage to the links 37*a*, 37*b* to bias the hinge plates 13 to pivot upward and downward.

Figure 10:
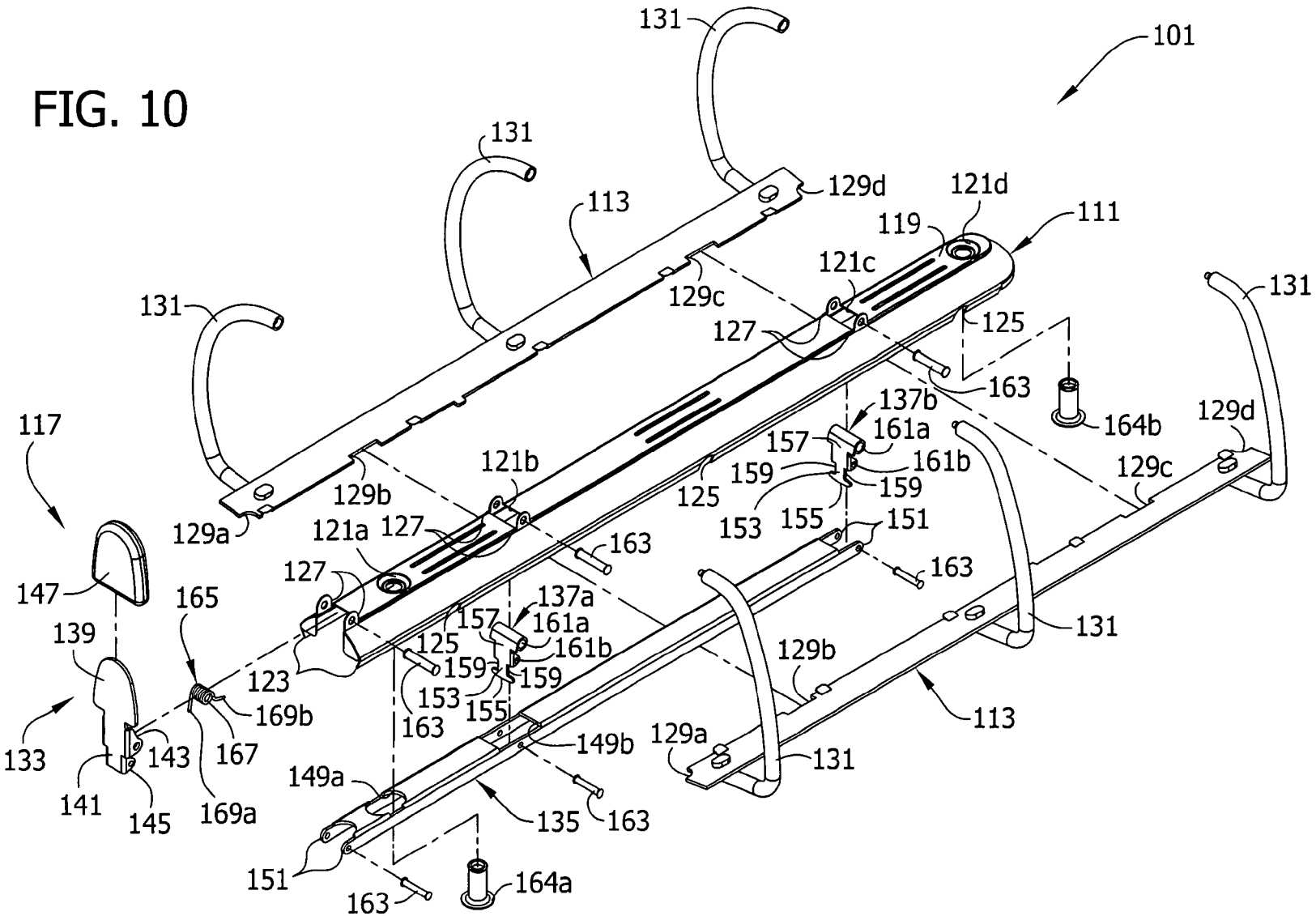
FIG. 10 is an exploded perspective of a ring binder mechanism according to a second embodiment of the invention.
Figure 11:
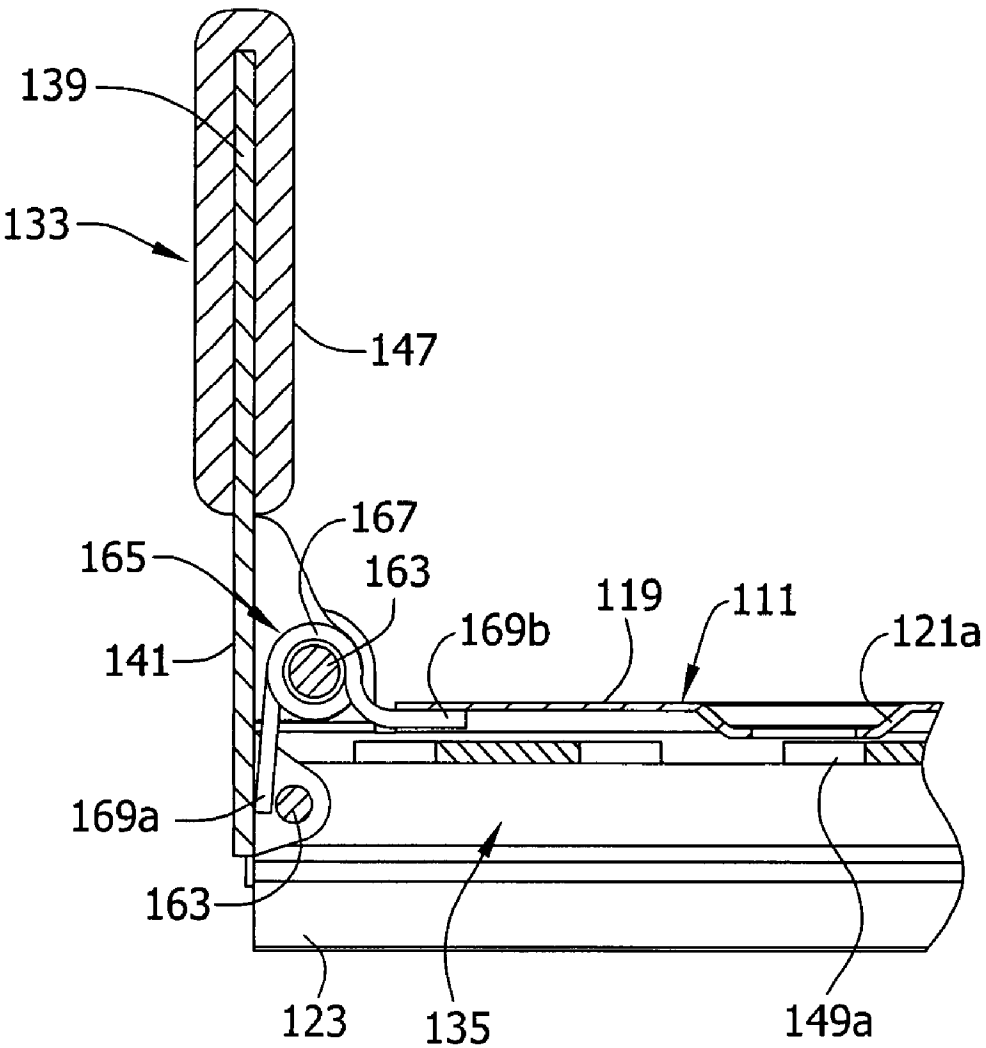
FIG. 11 is an enlarged, fragmentary, longitudinal section of the ring mechanism at a closed and locked position and with components removed.
Figure 12:
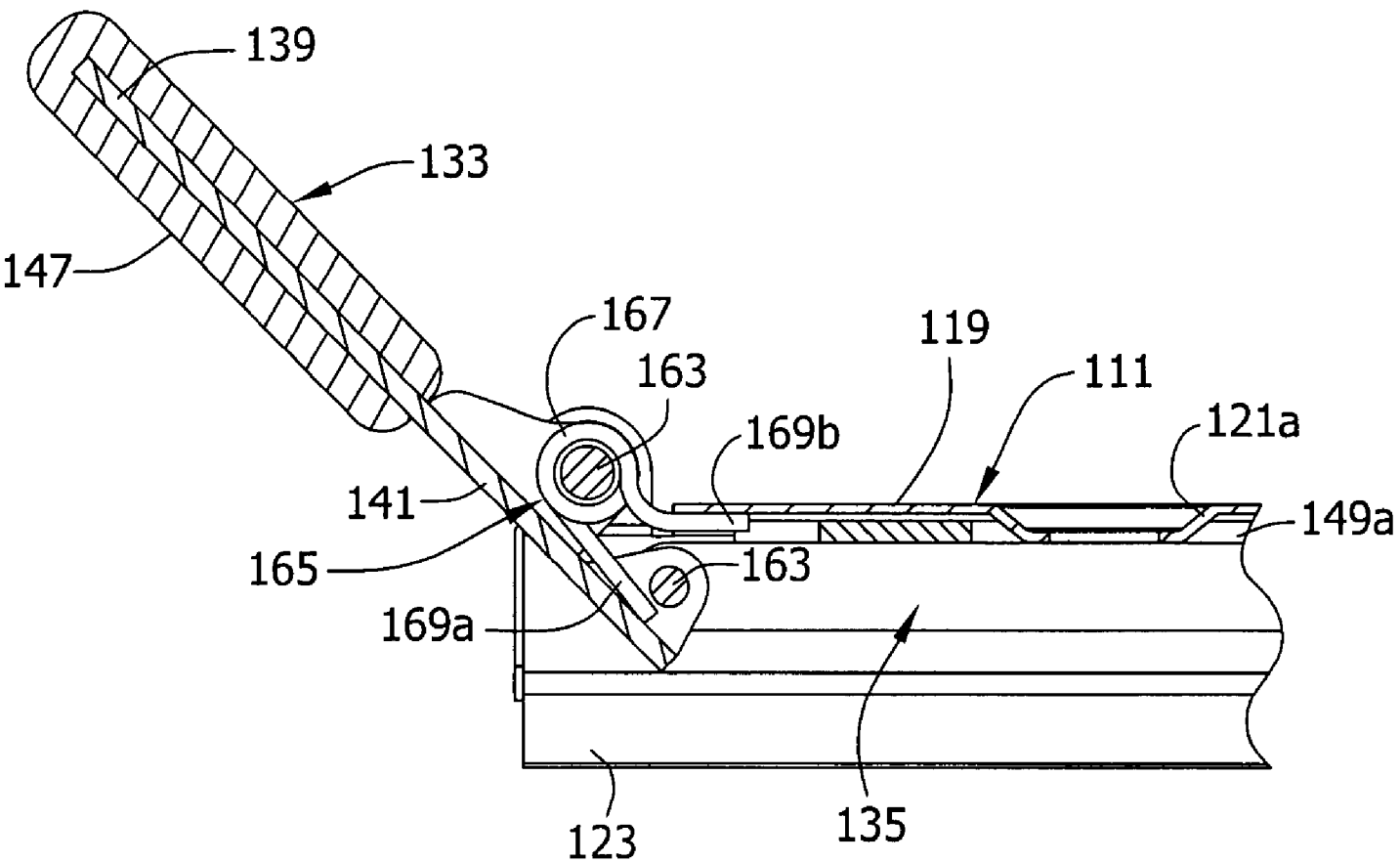
FIG. 12 is a section similar to FIG. 11 with the ring mechanism at an open position.

FIGS. 10-12 illustrate a second embodiment of the ring binder mechanism of the invention. The mechanism of this embodiment is indicated generally by reference numeral 101, and parts of this ring mechanism 101 corresponding to parts of the ring mechanism 1 of the first embodiment are designated by the same reference numerals, plus "100". The ring mechanism 101 of this embodiment is substantially the same as the ring mechanism 1 of the first embodiment, but additionally includes a coiled torsion spring (designated generally by reference numeral 165), or shank spring, adjacent lever 133. The torsion spring 165 interacts with control structure 117 through the lever 133 to urge the control structure 117 toward a locked position when ring members 131 move to their closed position.

As shown in FIG. 10, the torsion spring 165 includes a coiled body 167 and two free ends 169*a*, 169*b*. Referring to FIGS. 11 and 12, body 167 of the torsion spring 165 is received around hinge pin 163, which mounts the lever 133 on the housing 111. The first free end 169*a* of the torsion spring 165 engages lever neck 141 while the second free end 169*b* engages housing 111 under plateau 119. Thus, the torsion spring 165 is oriented to resist movement of the control structure 117 in a direction tending to open the ring members 131. More specifically, it is oriented to resist pivoting movement of the lever 133 outward and downward (i.e., movement of the first end 169*a* of the spring 165 toward the second end 169*b*), which operates to open the ring members 131.

Operation of the ring mechanism 101 between the closed (FIG. 11) and open (FIG. 12) positions is substantially the same as operation of the ring mechanism 1 of the first embodiment. When the ring mechanism 101 is closed and locked, the torsion spring 165 is more relaxed. To open the mechanism 101, an operator pivots the lever 133 outward and downward. The first free end 169*a* of the torsion spring 165 moves with the lever neck 141 toward the second free 169*b* end of the spring, causing the torsion spring to compress (compare FIG. 11 to FIG. 12). The torsion spring 165 tends to resist this opening movement of the lever 133 so that if the lever is released before the ring members 131 open (i.e., before hinge plates 113 pivot upward and through their co-planar position), the torsion spring immediately urges the lever 133 back to its upright position and pulls travel bar 135 and links 137*a*, 137*b* back to their locked position.

When the ring mechanism 101 is open (FIG. 12), the hinge plates 113 are in an upwardly hinged position and the links 137*a*, 137*b* (not shown in FIG. 12) are angled away (over center) from the lever 133 in substantially the same position as the links 37*a*, 37*b* of the first embodiment of FIGS. 1-9 (and as particularly shown in FIGS. 7-9). The spring force of the housing 111 holds the hinge plates 113 in their upwardly hinged position, and holds the connecting links 137*a*, 137*b* in their open position against the bias force of the torsion spring 165 urging the links 137*a*, 137*b* (via the lever 133 and travel bar 135) toward their locked position (which would cam the hinge plates 113 downward toward their co-planar position). It is to be understood that when the links 137*a*, 137*b* are in their open position, they are angled slightly away from the lever (not shown, but again substantially similar to the link position of the first embodiment shown in FIGS. 7-9). The over center position of the links 137*a*, 137*b* slightly helps the mechanism 101 resist the bias force of the torsion spring 165 which tends to pivot the lever 133 upward and inward to close and lock the mechanism. However, this link resistance is small in comparison to the resistance provided by the spring force of the housing 111 and alone would not be enough to resist the spring's force.

To move the ring mechanism 101 back to its closed position, either the lever 133 can be pivoted upward and inward or the ring members 131 can be manually pushed together. As described for the first embodiment of FIGS. 1-9, both of these operations cause the hinge plates 113 to pivot downward. In this embodiment, as soon as the hinge plates 113 pass through their co-planar position (and the housing spring force biases them to pivot fully downward to close the ring members 131), the torsion spring 165 drives the lever 133 to pivot to its full vertical position. This automatically pulls the travel bar 135 toward the lever 133 and pivots the links 137*a*, 137*b* to their over-center, locked position. Thus, the ring mechanism 101 is automatically locked when the ring members 131 close.

FIGS. 13-22 show a third embodiment of the ring mechanism of the invention. The mechanism of this embodiment is indicated generally by reference numeral 201. Parts of the ring mechanism 201 of this embodiment corresponding to parts of the ring mechanism 1 of the first embodiment are indicated by the same reference numerals, plus "200", and parts of the ring mechanism 201 of this embodiment corresponding to parts of the ring mechanism 101 of the second embodiment are indicated by the same reference numerals, plus "100". The ring mechanism 201 is similar to the ring mechanism 101 of the second embodiment with the general exception of hinge plates 213 and control structure 217, as will be described.

Figure 13:
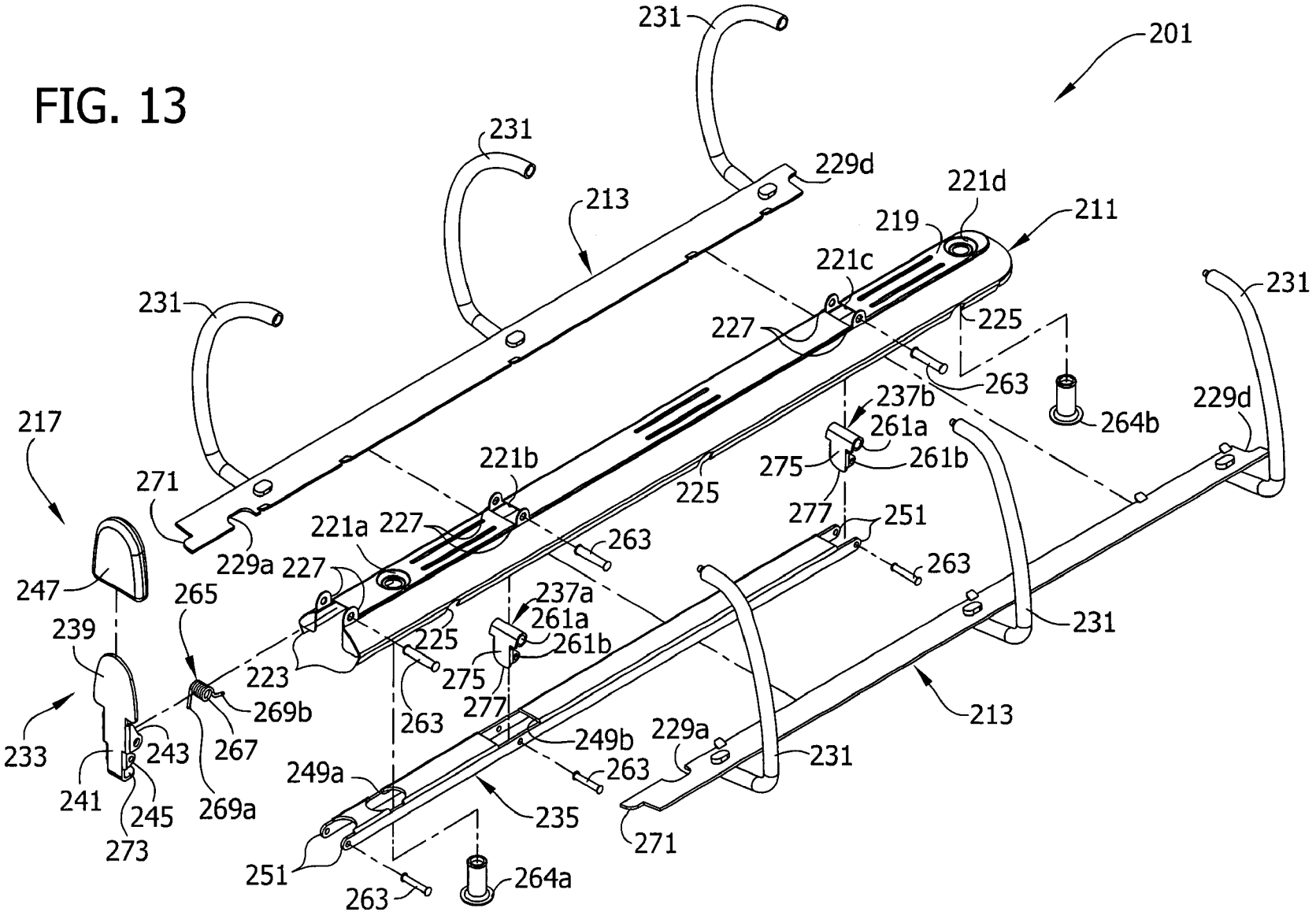
FIG. 13 is an exploded perspective of a ring binder mechanism according to a third embodiment of the invention.
Figure 14:
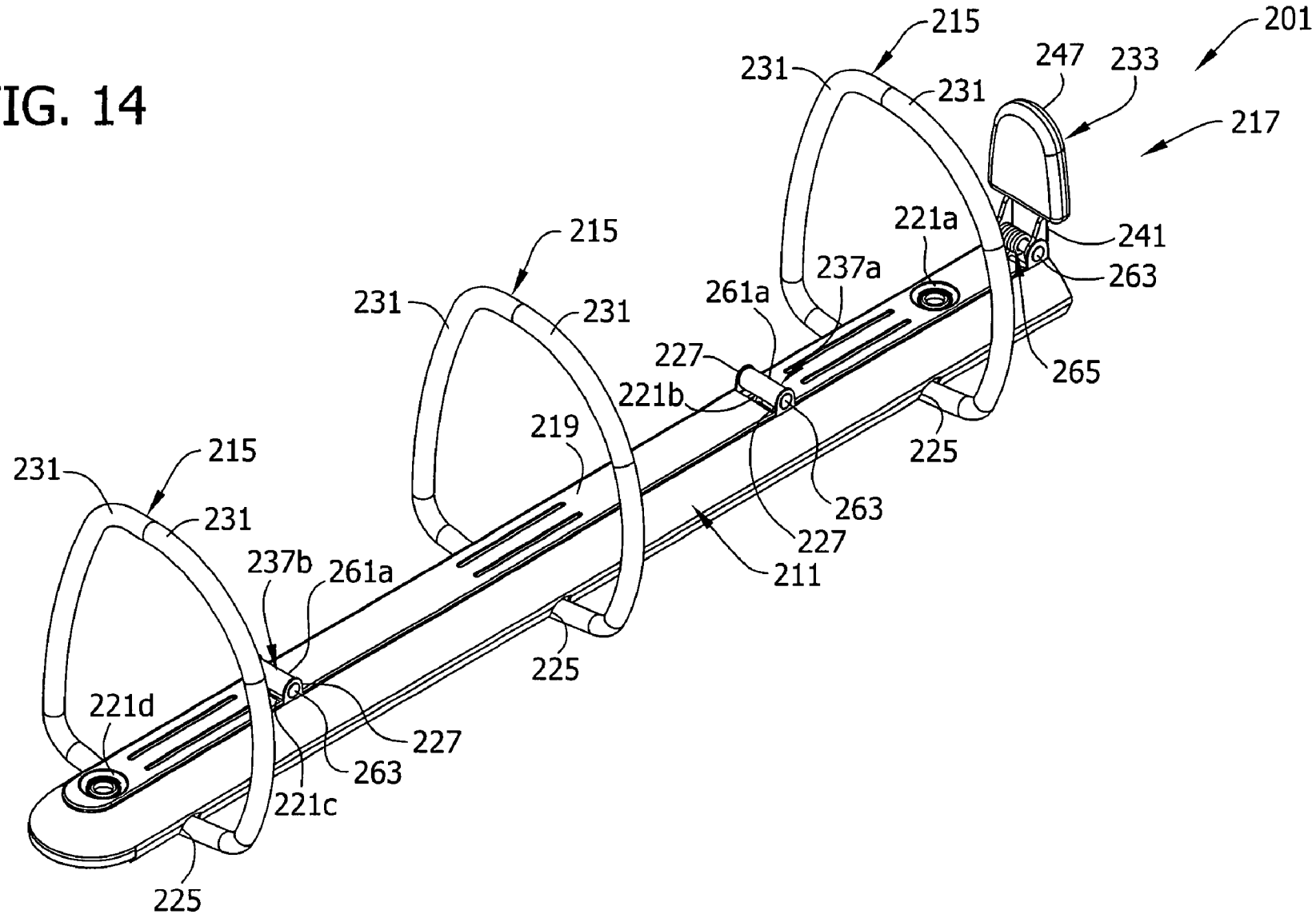
FIG. 14 is a perspective of the ring mechanism of FIG. 13 at a closed and locked position.
Figure 15:
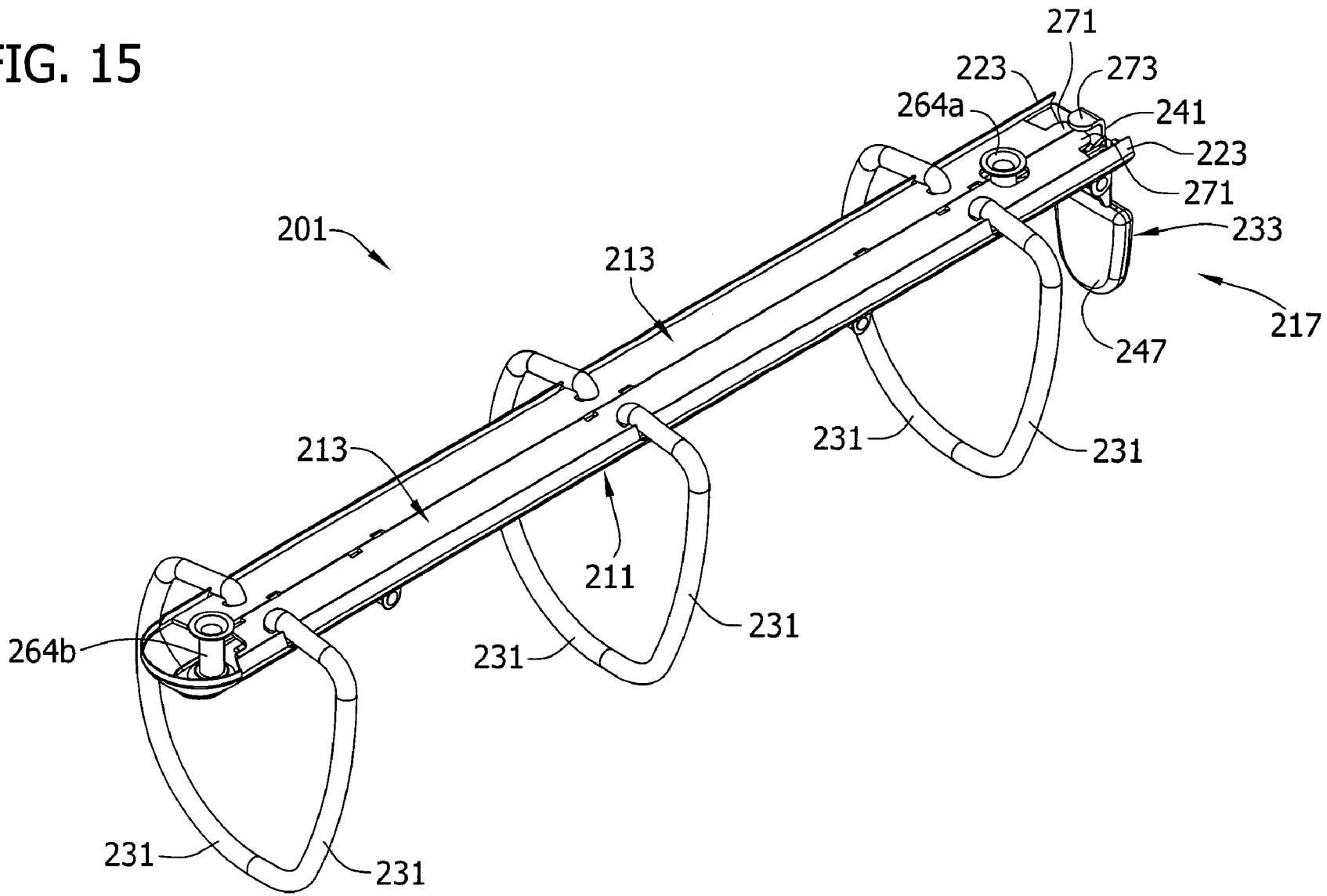
FIG. 15 is the perspective of FIG. 14 inverted.
Figure 16:
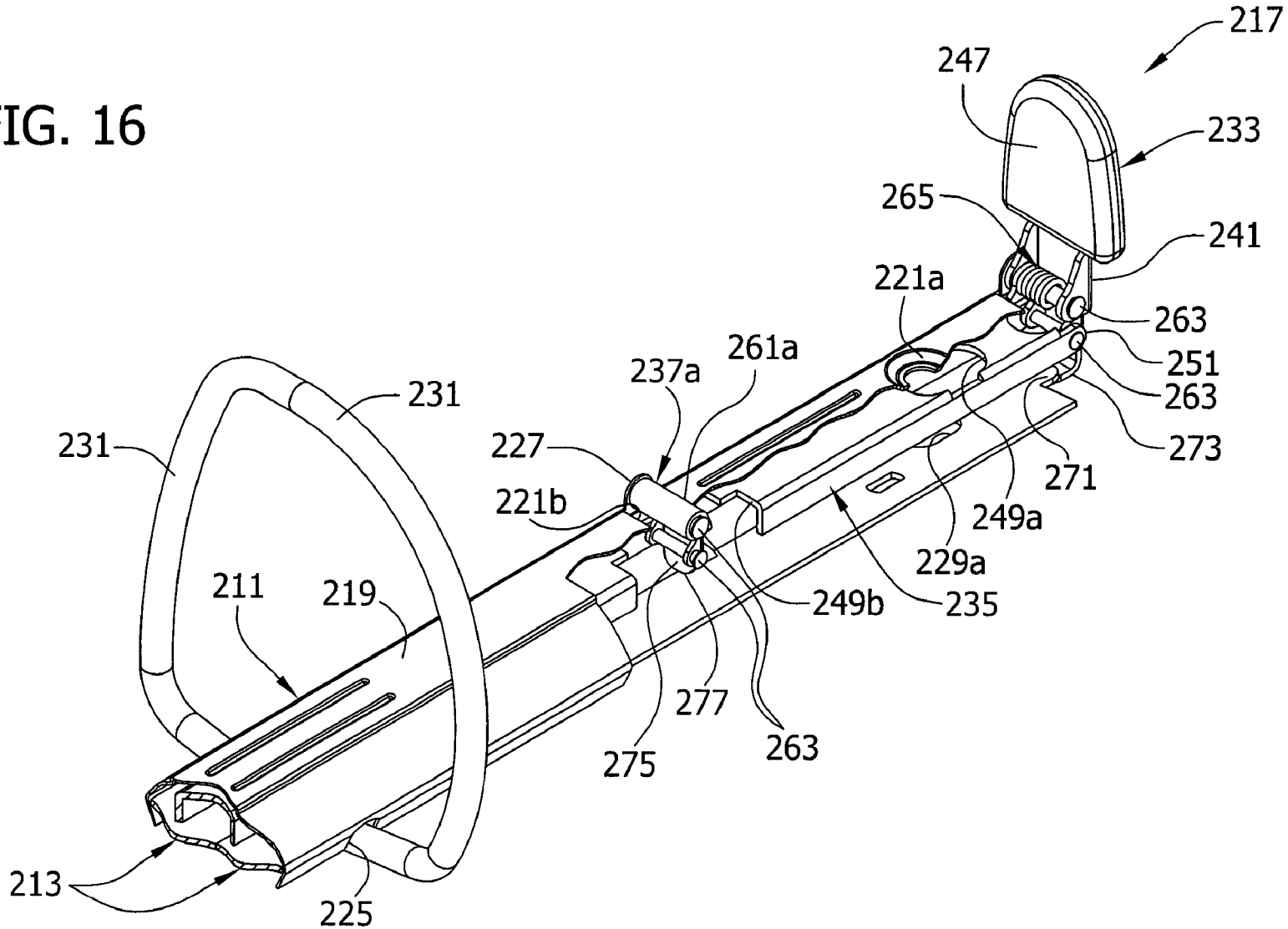
FIG. 16 is an enlarged and fragmentary perspective of the ring mechanism of FIG. 14 with parts broken away to show internal construction.
Figure 17:
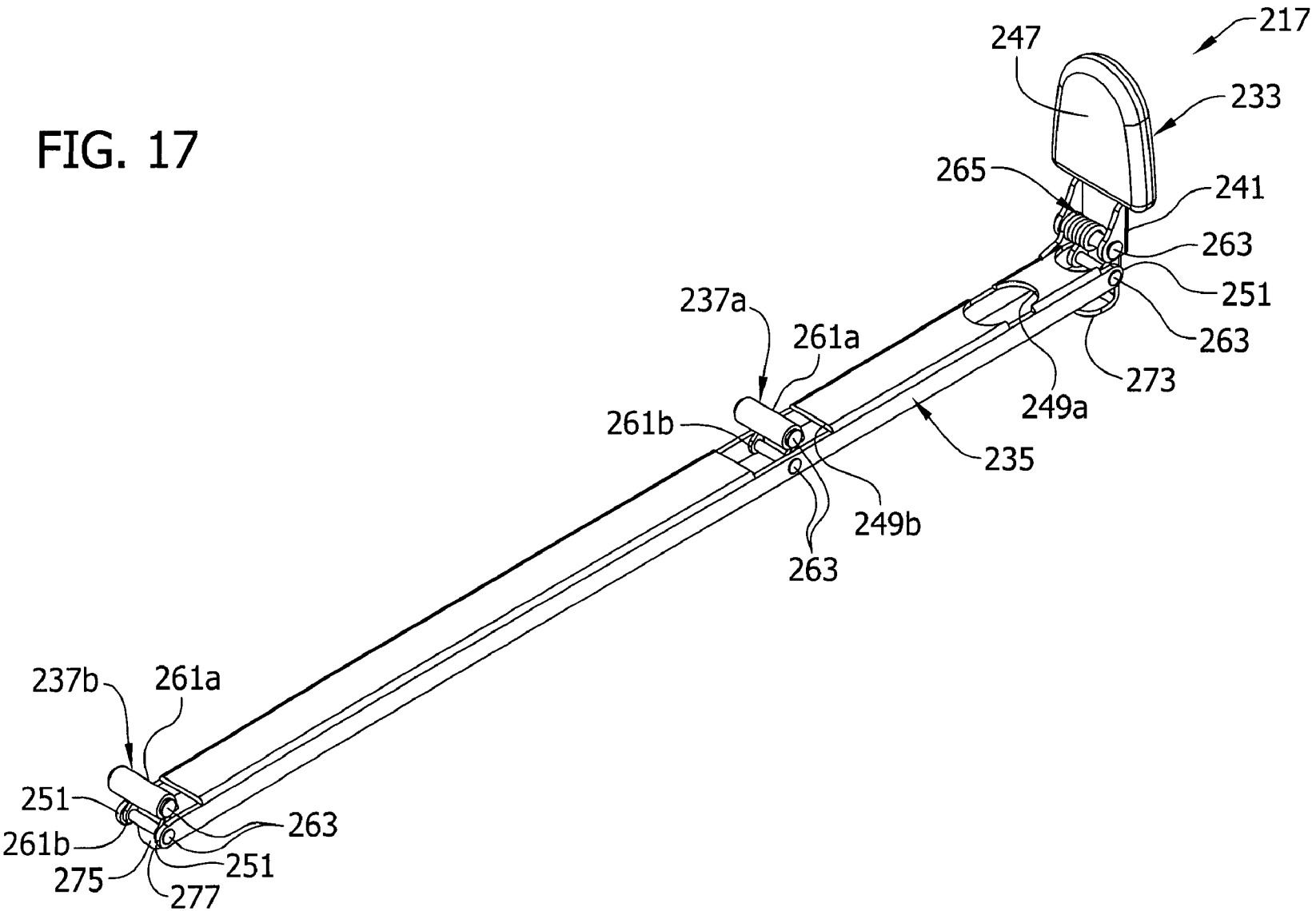
FIG. 17 is an enlarged perspective of the control structure of the ring mechanism of FIG. 14.
Figure 18:
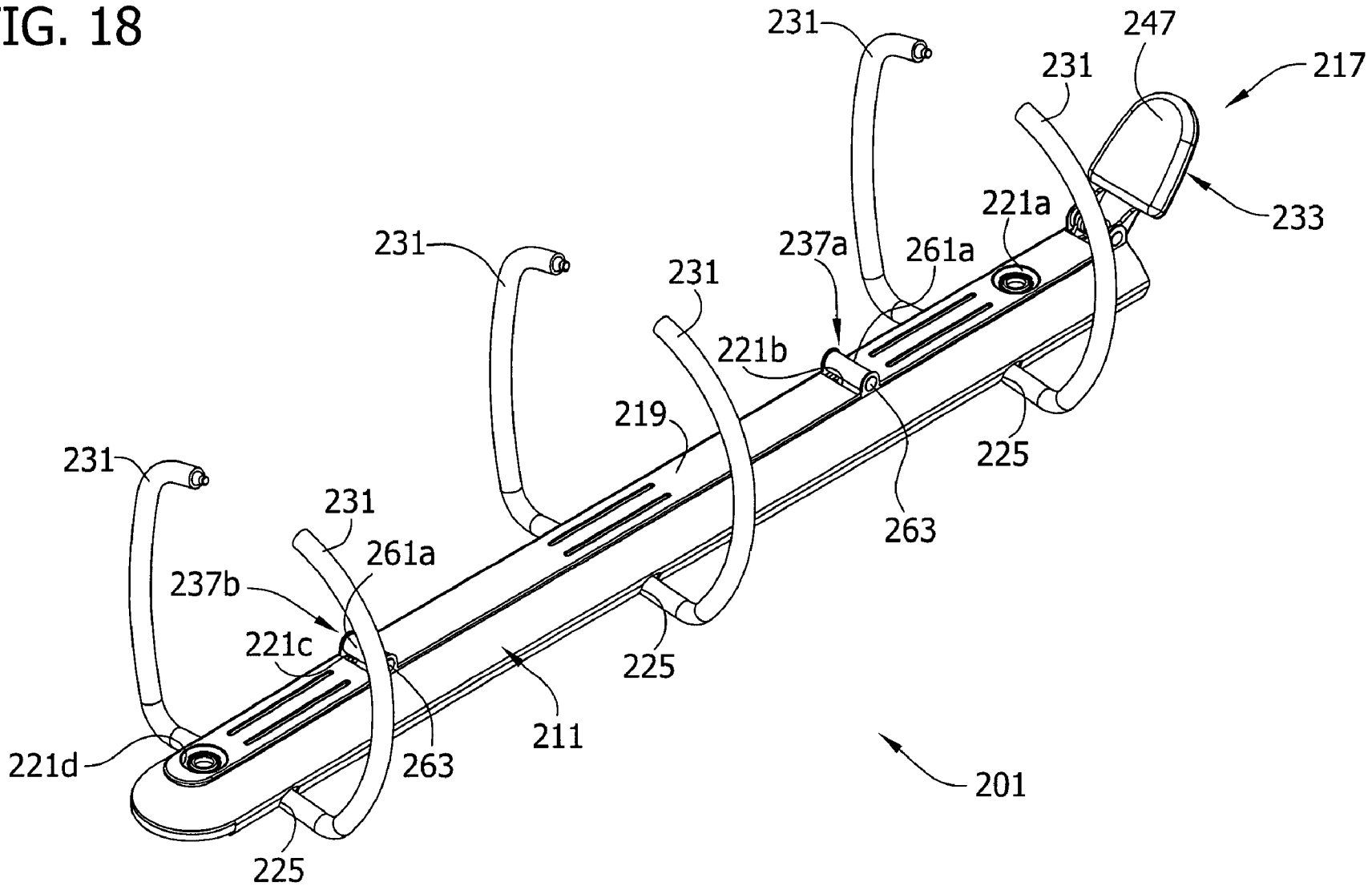
FIG. 18 is a perspective of the ring mechanism at an open position.
Figure 19:
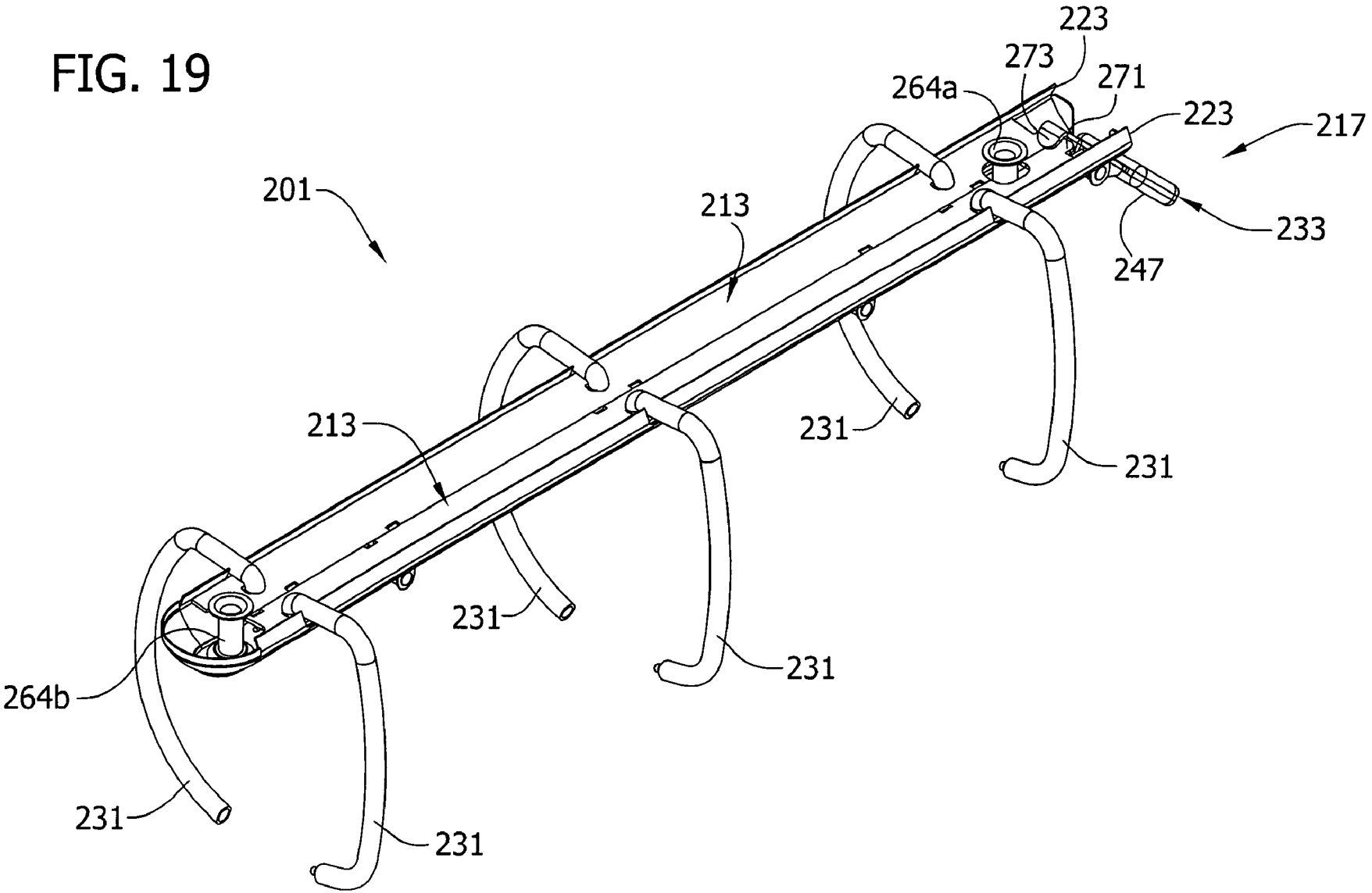
FIG. 19 is the perspective of FIG. 18 inverted.
Figure 20:
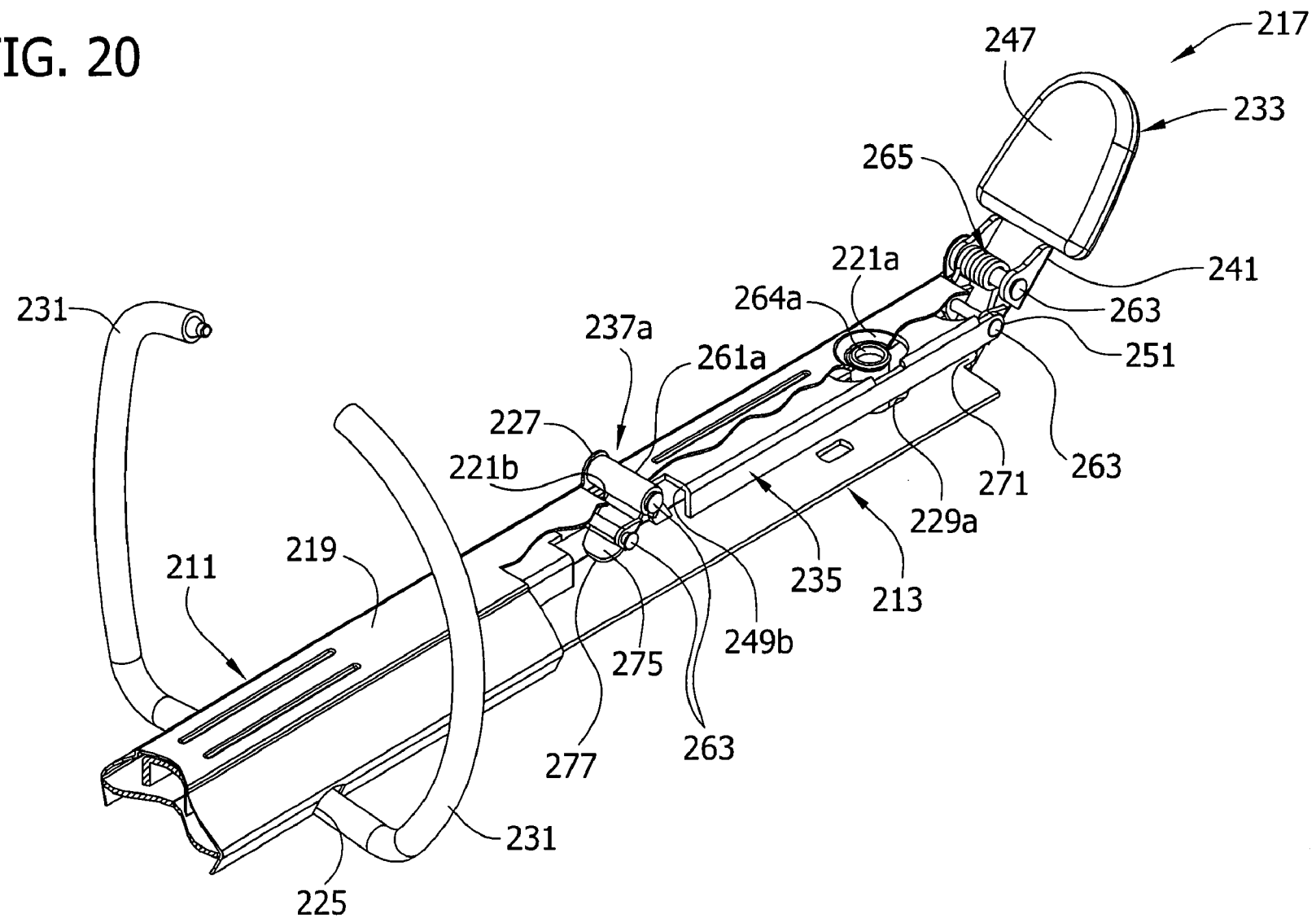
FIG. 20 is a perspective similar to FIG. 16 with the ring mechanism at an open position and with components removed.
Figure 21:
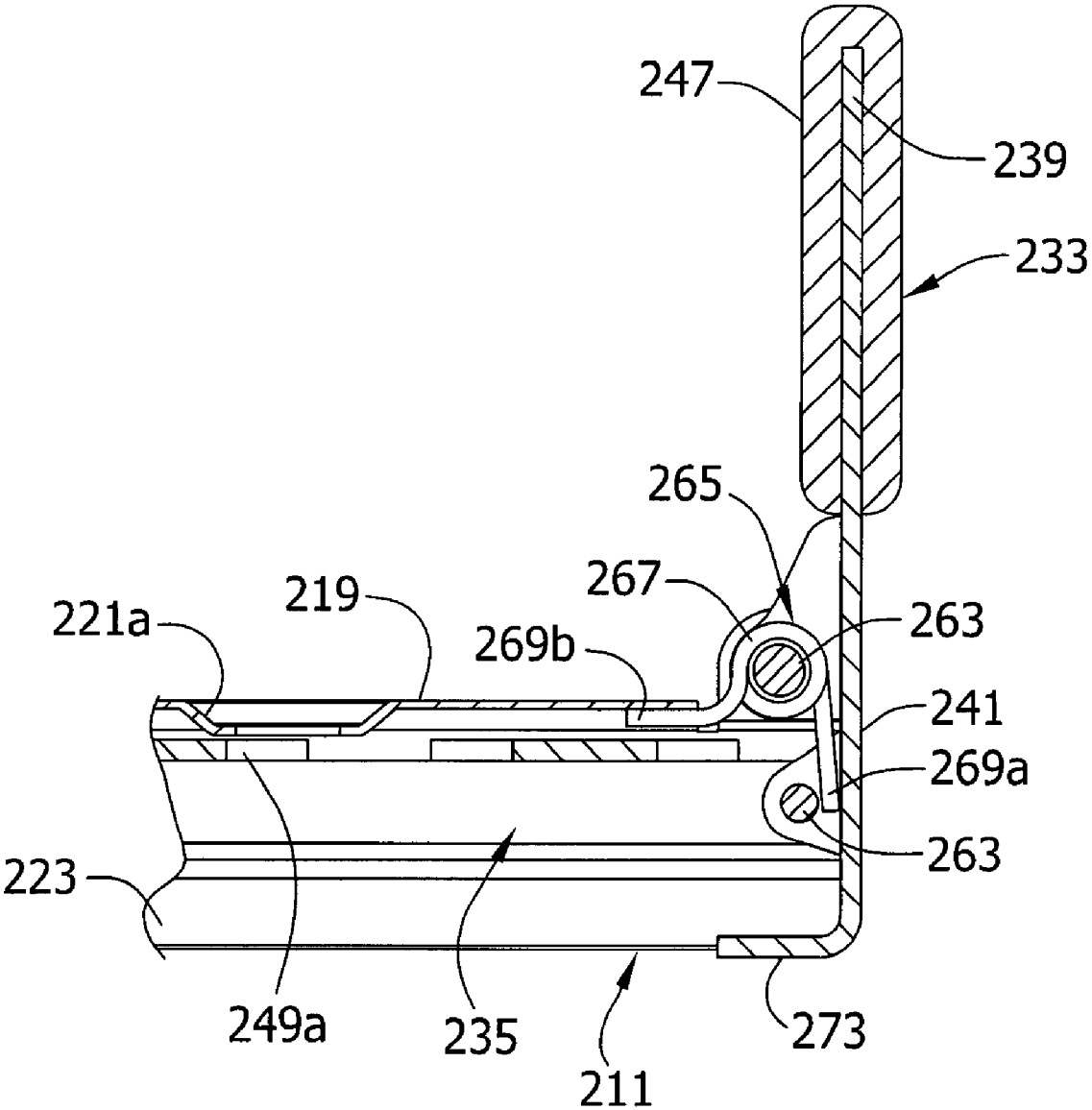
FIG. 21 is an enlarged, fragmentary, longitudinal section of the ring mechanism of FIG. 14.
Figure 22:
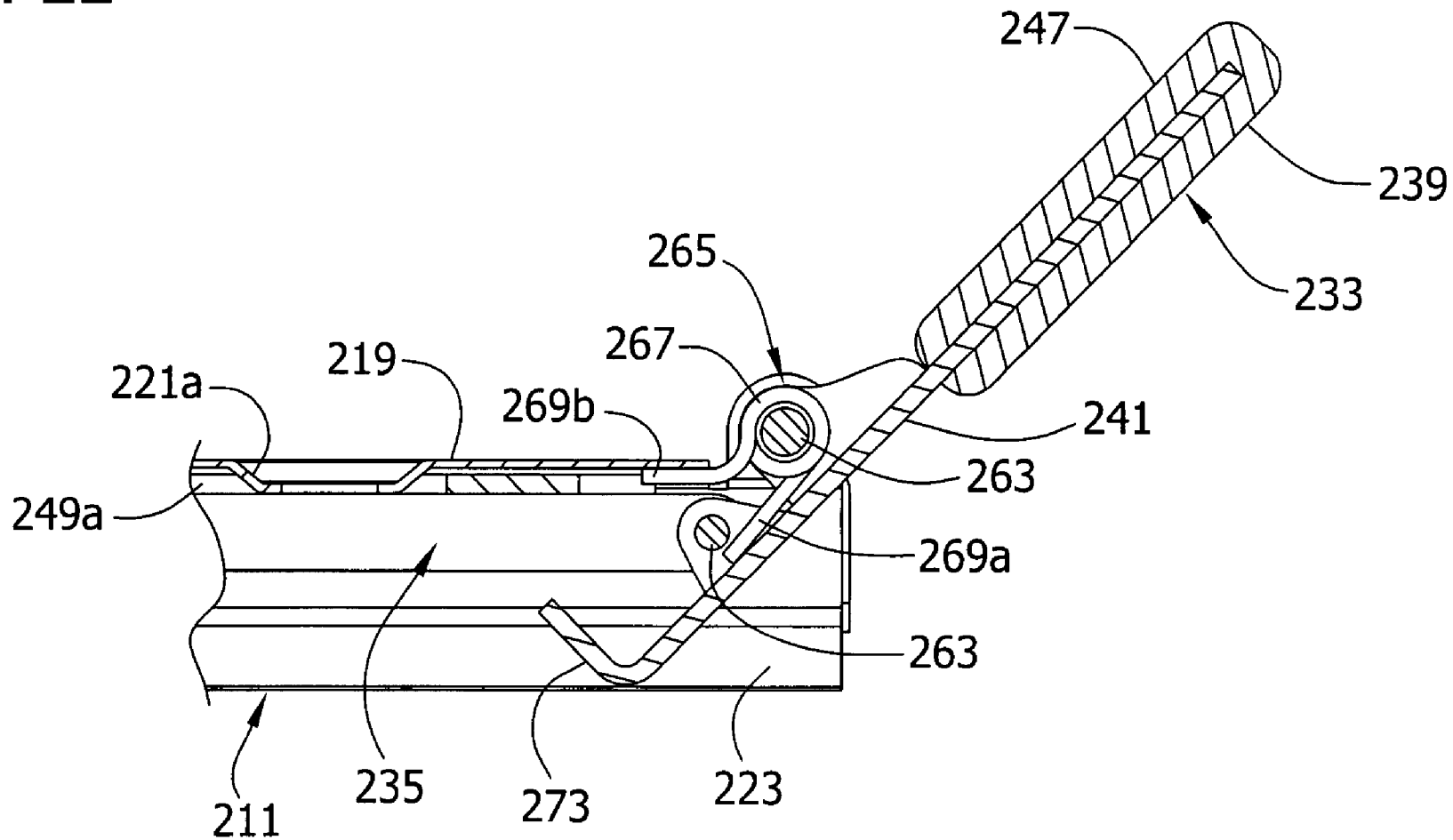
FIG. 22 is an enlarged, fragmentary, longitudinal section of the ring mechanism of FIG. 18.

As shown in FIG. 13, each hinge plate 213 includes two arcuate openings 229*a*, 229*d* along its inner longitudinal edge margin and a finger 271 extending longitudinally outward from an end of the plate nearest an open end of housing 211. The control structure 217 includes a lever 233, a travel bar 235, and two links 237*a*, 237*b*. The lever 233 is substantially the same as the lever 33, 133 of the first and second embodiments, which were previously described and are illustrated in FIGS. 1-12, but is modified to include an opening arm 273 at the bottom end of neck 241. In addition, each link 237*a*, 237*b* is similar to the links 37*a*, 37*b*, 137*a*, 137*b* previously described, but is modified to include a single body 275 with an engagement edge 277. The links 237*a*, 237*b* are located entirely above the hinge plates and do not have a tongue and enlarged head as do the links 37*a*, 37*b*, 137*a*, 137*b*.

The assembled ring mechanism 201 is shown in FIGS. 14-16 and 21 in a closed and locked position. Ring members 231 are closed and the links 237*a*, 237*b* are in an over-center, locked position, with their engagement edges 277 angling slightly toward the lever 233. The hinge plate fingers 271 of the interconnected hinge plates 213 are positioned above the opening arm 273 of the lever 233 and the engagement edges 277 of the links 237*a*, 237*b* are in contact with an upper surface of the hinge plates 213 (generally at the hinge). The links 237*a*, 237*b* do not extend through the interconnected hinge plates 213 as the links of the previous embodiments do. But the links 237*a*, 237*b* are still in position to block the hinge plates 213 (through engagement with the edges 277) from pivoting upward to open the ring members 231.

To move the mechanism 201 to its open position (FIGS. 18-20 and 22), an operator pivots the lever 233 outward and downward. The pivoting movement of the lever 233 pushes the travel bar 235 away from the lever and causes the links 37*a*, 37*b* to pivot about respective hinge pins 263 connecting them to the housing 211. The opening arm 273 of the lever 233 is initially spaced apart from a lower surface of the interconnected hinge plate fingers 271. This provides room for the lever 233 to pivot and swing the links 237*a*, 237*b* out of their over-center, locking position, through a vertical position, and away from the lever 233 (FIG. 20) before the opening arm 273 engages the hinge plate fingers 271. The opening arm then engages the fingers 271 and begins pushing the hinge plates 213 upward (free of interference from the links 237*a*, 237*b* because they have already pivoted to an over center position away from the lever 233). As with torsion spring 165 in the second embodiment of FIGS. 10-12, the torsion spring 265 resists this lever movement tending to open the ring members 231. If the lever 233 is released before the ring members 231 open (i.e., before the hinge plates 213 pivot upward and through their co-planar position), the torsion spring 265 immediately urges the lever back to its upright position and pulls travel bar 235 and links 237*a*, 237*b* back to their locked position.

As the operator continues to pivot the lever 233 to open the mechanism 201, the links 237*a*, 237*b* continue to pivot away from the lever 233. This allows the hinge plates 213 to pivot fully upward through their co-planar position to open the ring members 231. In this open position of the ring mechanism 201, the links 237*a*, 237*b* no longer block the hinge plates' pivoting motion. The housing's spring force holds the hinge plates 213 in their upwardly hinged position with the ring members 231 open. The operator may let go of the lever 233 to load or remove pages from the mechanism 201. As in the second embodiment of FIGS. 10-12, the spring force of the housing 211 resists the bias force of the torsion spring 265 urging the control structure 217 back toward its locked position. In particular, the housing spring force prevents the links 237*a*, 237*b* from pushing the hinge plates 213 downward through their co-planar position to close the ring members 231.

To close the ring members 231 and return the ring mechanism 201 to its closed and locked position, the operator either pivots the lever 233 inward and upward or pushes the ring members 231 together. As in the previous embodiments, both of these actions move the hinge plates 213 downward. In this embodiment, as in the second embodiment, as soon as the hinge plates 213 pass through their co-planar position (and the housing spring force biases them to pivot fully downward to close the ring members 231), the torsion spring 265 drives the lever 233 to pivot to its full vertical position. This automatically pulls the travel bar 235 toward the lever 233 and pivots the links 237*a*, 237*b* to their over-center, locked position. Thus, the ring mechanism 201 is automatically locked when the ring members 231 close.

It is to be understood that the components of the ring binder mechanism of the invention are made of a suitable rigid material, such as a metal (e.g., steel). Mechanisms with components made of non-metallic materials, specifically including a plastic, do not depart from the scope of this invention.

When introducing elements of this invention or the embodiments thereof, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and variations of these terms is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for retaining loose-leaf pages, the mechanism comprising:

a housing;

hinge plates supported by the housing for pivoting motion about a pivot axis;

rings for holding loose-leaf pages, each ring including a first ring member mounted on a first hinge plate and moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings; and a control structure comprising a lever pivotally mounted on the housing, a travel bar operatively connected to the lever, and a link pivotally connected to the housing and to the travel bar, the link capturing the hinge plates such that pivoting motion of the hinge plates toward the closed positions of the ring members and toward the open positions of the ring members can be driven by pivoting movement of the link relative to the housing, the lever being pivotable on the housing to move the travel bar generally lengthwise of the housing and thereby pivot the links for use in controlling the pivoting motion of the hinge plates.

2. The ring binder mechanism as set forth in claim 1 wherein the control structure is movable between a first position in which the link is positioned to lock the ring members in the closed positions of the ring members, and a second position in which the hinge plates may freely pivot.

3. The ring binder mechanism as set forth in claim 2 wherein the hinge plates comprise an opening, the link extending through the opening.

4. The ring binder mechanism as set forth in claim 3 wherein the link comprises a head located below the hinge plates, a shoulder located above the hinge plates and a neck extending through the opening in the hinge plates.

5. The ring binder mechanism as set forth in claim 1 further comprising a spring engaging the lever for biasing the lever toward the first position of the control structure.

6. The ring binder mechanism set forth in claim 1 in combination with a cover, the ring binder mechanism being mounted on the cover.

7. A ring binder mechanism for retaining loose-leaf pages, the mechanism comprising:

a housing;

hinge plates supported by the housing for pivoting motion about a pivot axis;

rings for holding loose-leaf pages, each ring including a first ring member mounted on a first hinge plate and moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings; and a control structure supported by the housing and comprising a lever, a travel bar operatively connected to the lever, at least one link connected to the travel bar and the housing, and a spring engaging the lever, the control structure being movable relative to the housing between a first position corresponding to the closed positions of the ring members and a second position corresponding with the open position, the link being engageable with at least one of the hinge plates in the first position for blocking the hinge plates from pivoting to move the ring members to their open position thereby to lock the ring members in their closed positions, the link rotating about a substantially horizontal axis through a vertical position to an over center position as the control structure moves from the second position to the first position, the spring biasing the lever toward the first position of the control structure.

8. The ring binder mechanism set forth in claim 7 wherein the control structure is adapted to move the link to a location in the second position of the control structure in which the link does not inhibit pivoting motion of the hinge plates.

9. The ring binder mechanism set forth in claim 8 wherein the link is disposed relative to the hinge plates for engaging at least one the hinge plates as the control structure moves from its second position to its first position for pivoting the hinge plates to move the ring members from their open positions to their closed positions.

10. The ring binder mechanism as set forth in claim 9 wherein the link is connected to the hinge plates for driving pivoting motion of the hinge plates from the closed positions of the ring members to the open positions of the ring members.

11. The ring binder mechanism set forth in claim 7 wherein the spring comprises a coil torsion spring having one free end engaging the housing and another free end engaging the lever.

12. The ring binder mechanism set forth in claim 7 wherein the link is pivotally connected to the travel bar.

13. The ring binder mechanism as set forth in claim 12 wherein the link is pivotally connected to the housing.

14. The ring binder mechanism set forth in claim 13 wherein the housing includes an opening, the link being pivotally connected to the housing in said opening.

15. The ring binder mechanism set forth in claim 7 wherein there are two links, each pivotally connected to the housing and the travel bar.

16. The ring binder mechanism as set forth in claim 7 wherein the travel bar has an opening therein for receiving a post through the travel bar to permit movement of the travel bar relative to the post.

17. The ring binder mechanism set forth in claim 16 in combination with a cover, the ring binder mechanism comprising at least one post mounting the ring binder mechanism on the cover and passing through the opening in the travel bar.

* * * * *